US009850107B2

(12) United States Patent
Iwazawa

(10) Patent No.: US 9,850,107 B2
(45) Date of Patent: Dec. 26, 2017

(54) MOBILE CRANE

(71) Applicant: KOBELCO CONSTRUCTION MACHINERY CO., LTD., Hiroshima-shi (JP)

(72) Inventor: Takahiro Iwazawa, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 15/204,342

(22) Filed: Jul. 7, 2016

(65) Prior Publication Data

US 2017/0015533 A1 Jan. 19, 2017

(30) Foreign Application Priority Data

Jul. 14, 2015 (JP) ..... 2015-140303

(51) Int. Cl.
*B66C 13/18* (2006.01)
*B66C 23/74* (2006.01)

(52) U.S. Cl.
CPC ..... *B66C 13/18* (2013.01); *B66C 23/74* (2013.01)

(58) Field of Classification Search
CPC ..... B66C 23/53; B66C 23/72; B66C 23/74; B66C 23/76; B66C 23/78; B66C 23/80
See application file for complete search history.

(56) References Cited

U.S. PATENT DOCUMENTS 3,842,984 A * 10/1974 Brown ..... B60G 3/00 212/195
4,103,783 A * 8/1978 Beduhn ..... B66C 23/74 212/195
4,382,519 A * 5/1983 Beduhn ..... B66C 23/74 212/195

(Continued)

FOREIGN PATENT DOCUMENTS

JP 60-146756 A 8/1985
JP 5-208796 8/1993

(Continued)

OTHER PUBLICATIONS

Japanese Office Action dated Apr. 18, 2017 in Patent Application No. 2015-140303 (with English translation).

*Primary Examiner* — Emmanuel M Marcelo
(74) *Attorney, Agent, or Firm* — Oblon, McClleland, Maier & Neustadt, L.L.P.

(57) ABSTRACT

A mobile crane includes: a crane main-body having a lower traveling body and an upper swing body; and a counterweight carrier. The counterweight carrier has a wheel, a wheel driving device, and a steering device. At least one of the crane main-body and the counterweight carrier has a controller which causes the steering device to steer the wheel. The controller causes the steering device to steer the wheel by a steering operation which requires a smaller steering amount of the wheel between one steering operation in which the steering device swivels the wheel in one direction to make the orientation of the wheel correspond to the front-back direction of the lower traveling body and another steering operation in which the steering device swivels the wheel in a direction opposite to the one direction to make the orientation of the wheel correspond to the front-back direction.

3 Claims, 15 Drawing Sheets

(56) References Cited

U.S. PATENT DOCUMENTS

| | | | | | |
|---|---|---|---|---|---|
| 4,540,097 | A * | 9/1985 | Wadsworth | ..... | B66C 23/74 212/178 |
| 2009/0272708 | A1 * | 11/2009 | Zollondz | ..... | B66C 23/74 212/196 |

FOREIGN PATENT DOCUMENTS

| | | | | |
|---|---|---|---|---|
| JP | 5-208797 | A | | 8/1993 |
| JP | 9-272456 | A | | 10/1997 |
| JP | 09272457 | A | * | 10/1997 |

* cited by examiner

MOBILE CRANE

TECHNICAL FIELD

The present invention relates to a mobile crane.

BACKGROUND ART

A known mobile crane is provided with a crane main-body capable of traveling and a counterweight carrier capable of traveling with the crane main-body. The counterweight carrier is used to have a counterweight mounted on it and increase the stability of the crane main-body to enhance the hoisting performance of the crane. Japanese Unexamined Patent Publication No. H5-208796 shows an example of a mobile crane provided with such a counterweight carrier.

The crane disclosed in Japanese Unexamined Patent Publication No. H5-208796 is provided with a crane main-body having a lower traveling body that is self-propelled in a front-back direction and an upper swing body mounted on the lower traveling body to be capable of swinging. In the crane, the lower traveling body is self-propelled as an operation lever used to run the main body is operated, whereby the crane main-body is caused to travel. A counterweight carrier is coupled to the back part of the upper swing body of the crane main-body via a coupling member.

The counterweight carrier is provided with a plurality of wheels and a carrier running motor. The carrier running motor rotates the wheels as the operation lever is operated. Thus, the counterweight carrier is caused to travel with the crane main-body. In addition, each of the wheels is able to swivel about a vertical axis. A traveling direction of the counterweight carrier may be changed by changing an orientation of each of the wheels.

At the traveling of the mobile crane, each of the wheels of the counterweight carrier is steered such that an orientation of each of the wheels corresponds to the front-back direction of the lower traveling body according to a swing state of the upper swing body. However, there is a case that such steering of the wheels requires a long time. The reason for it is as follows.

A rotation direction of the wheels driven by a carrier running motor is made correspondent to each operation of the operation lever by which the lower traveling body is instructed to move forward or backward. In steering the wheels, the wheels are steered such that a movement direction of the wheels when rotating in a rotation direction made correspondent to an operation of the operation lever by which the lower traveling body is instructed to move forward corresponds to the front side of the lower traveling body and such that a movement direction of the wheels when rotating in a rotation direction made correspondent to an operation of the operation lever by which the lower traveling body is instructed to move backward corresponds to the back side of the lower traveling body. Therefore, for example, even if an orientation of each of the wheels is initially set to a direction relatively close to the front-back direction of the lower traveling body, it is required to steer the wheels by an amount close to 180° when a movement direction of the wheels according to an operation of the operation lever is nearly opposite to a traveling direction of the lower traveling body according to the operation of the operation lever. The steering of the wheels requires a long time.

SUMMARY OF INVENTION

The present invention has an object of providing a mobile crane capable of reducing a time required for an adjustment operation in which the wheels of a counterweight carrier is steered to make an orientation of the wheels correspond to the front-back direction of the lower traveling body of a crane main-body.

A mobile crane according to an aspect of the present invention includes: a crane main-body having a lower traveling body capable of being self-propelled in a front-back direction and an upper swing body mounted on the lower traveling body to be capable of swinging; a coupling beam extending from the upper swing body to a back side of the upper swing body; and a counterweight carrier coupled to the upper swing body via the coupling beam and movable according to movement of the crane main-body in a state in which a counterweight is mounted on the counterweight carrier, wherein the counterweight carrier has a wheel rotatable in both directions about a horizontal axis, a wheel driving device which rotates the wheel, and a steering device which swivels the wheel about a vertical axis to steer the wheel, at least one of the crane main-body and the counterweight carrier has a posture instructing section configured to be operated to issue an instruction for causing the wheel to take a traveling posture with respect to the crane main-body during traveling the crane main-body, the traveling posture being a specific posture which the wheel takes by swiveling about the vertical axis, and a controller which causes the steering device to steer the wheel such that the wheel takes, as the traveling posture, a posture in which an orientation of the wheel corresponds to a front-back direction of the lower traveling body according to a swing state of the upper swing body when the posture instructing section is operated to issue the instruction for causing the wheel to take the traveling posture, and the controller causes the steering device to steer the wheel by a steering operation which requires a smaller steering amount of the wheel between one steering operation and another steering operation, one steering operation being a steering operation in which the steering device swivels the wheel in one direction about the vertical axis to make the orientation of the wheel correspond to the front-back direction of the lower traveling body, another steering operation being a steering operation in which the steering device swivels the wheel in a direction opposite to the one direction about the vertical axis to make the orientation of the wheel correspond to the front-back direction of the lower traveling body.

DESCRIPTION OF EMBODIMENTS

A description will be given, with reference to FIGS. 1 to 10, of a mobile crane 2 according to an embodiment of the present invention. Note that the mobile crane 2 will be simply called a crane 2 hereinafter.

Figure 1:
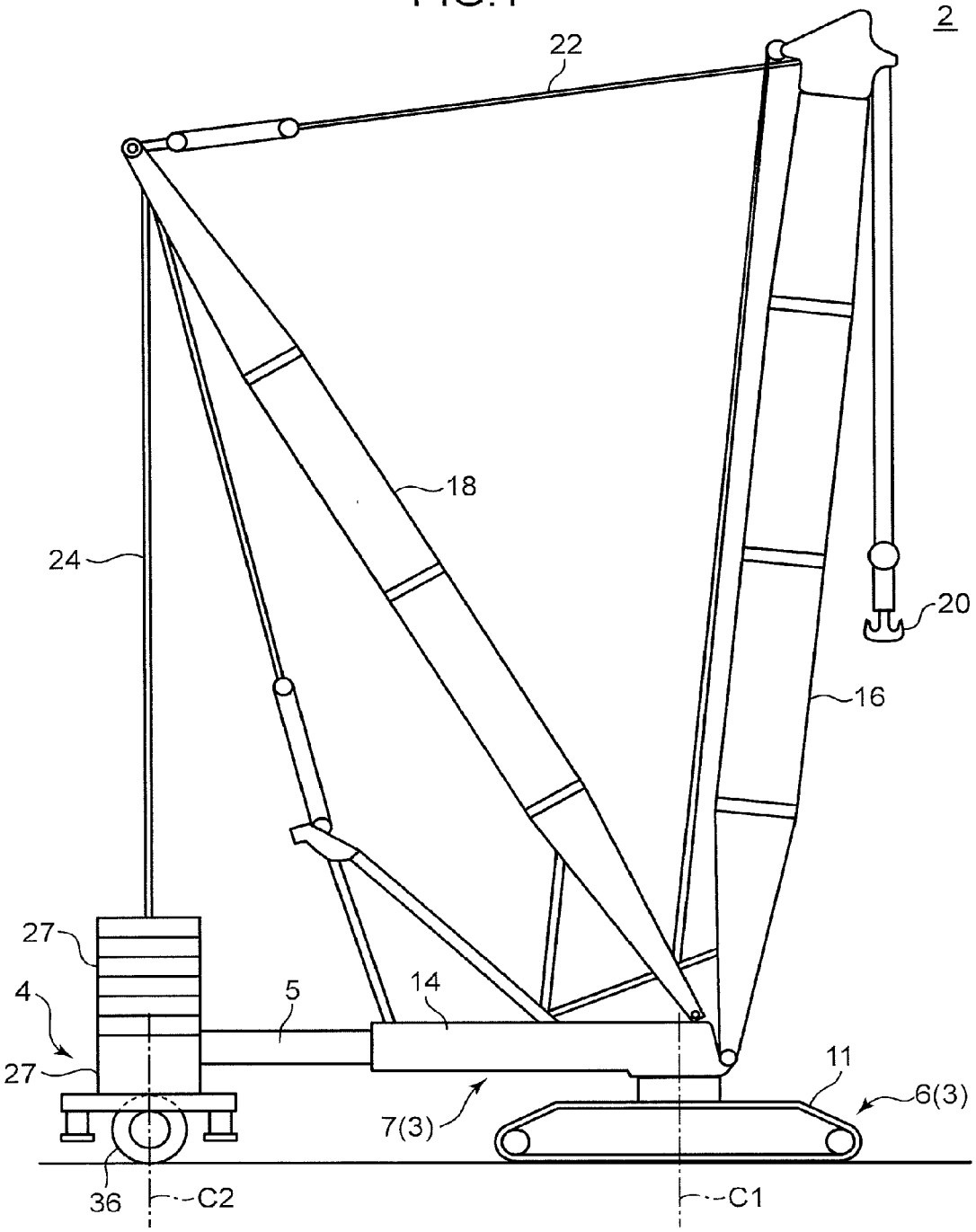
FIG. 1 is a side view of a mobile crane according to an embodiment of the present invention.

As shown in FIG. 1, the crane 2 according to the embodiment is provided with a crane main-body 3 that is configured to be capable of being self-propelled and performs a crane operation, a counterweight carrier 4 that is used to increase the stability of the crane main-body 3 to enhance its hoisting performance, and a coupling beam 5 that couples the crane main-body 3 and the counterweight carrier 4 to each other. Hereinafter, the counterweight carrier 4 will be simply called a carrier 4.

The crane main-body 3 is provided with a lower traveling body 6, an upper swing body 7, a swing-body driving device 8 (see FIG. 9), a traveling operation device 9, a swing operation device 10, and a swing-angle detecting section 25.

Figure 4:
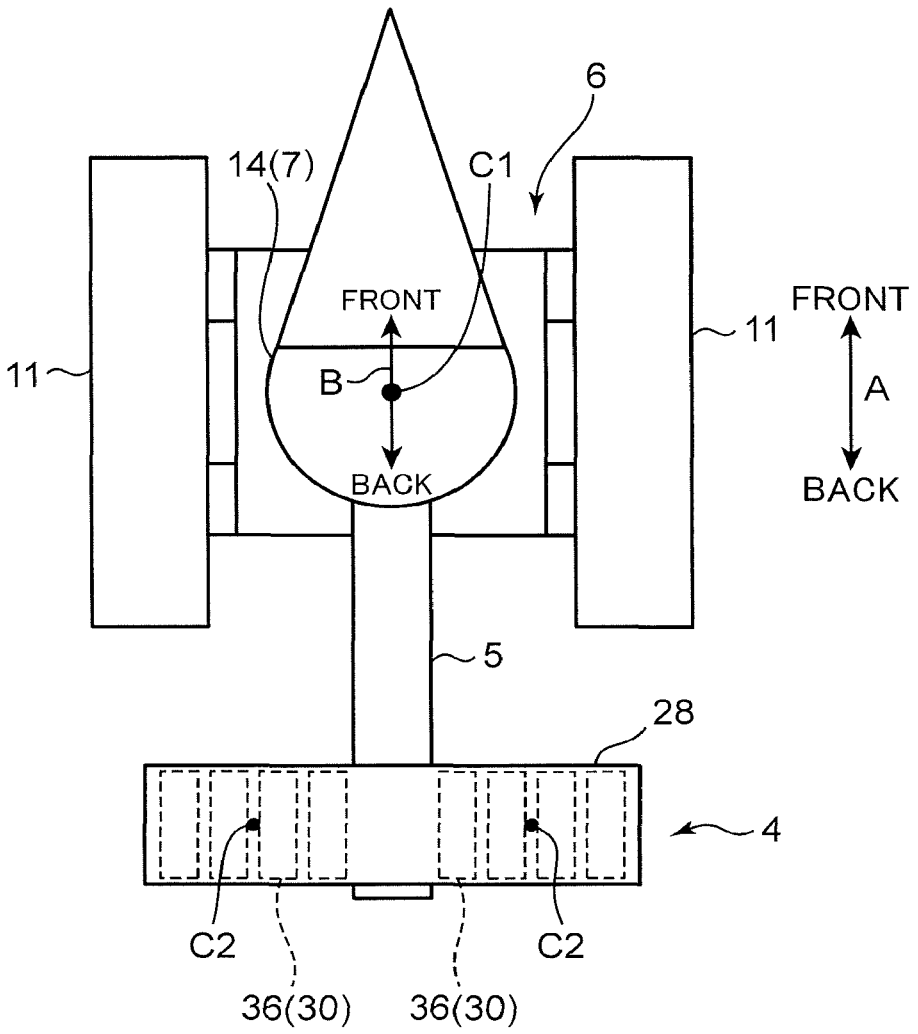
FIG. 4 is a schematic view of the mobile crane when seen from the upper side thereof in a state in which an upper swing body has a swing-angle of 0° (360°) and the wheel units take a traveling posture.
Figure 5:
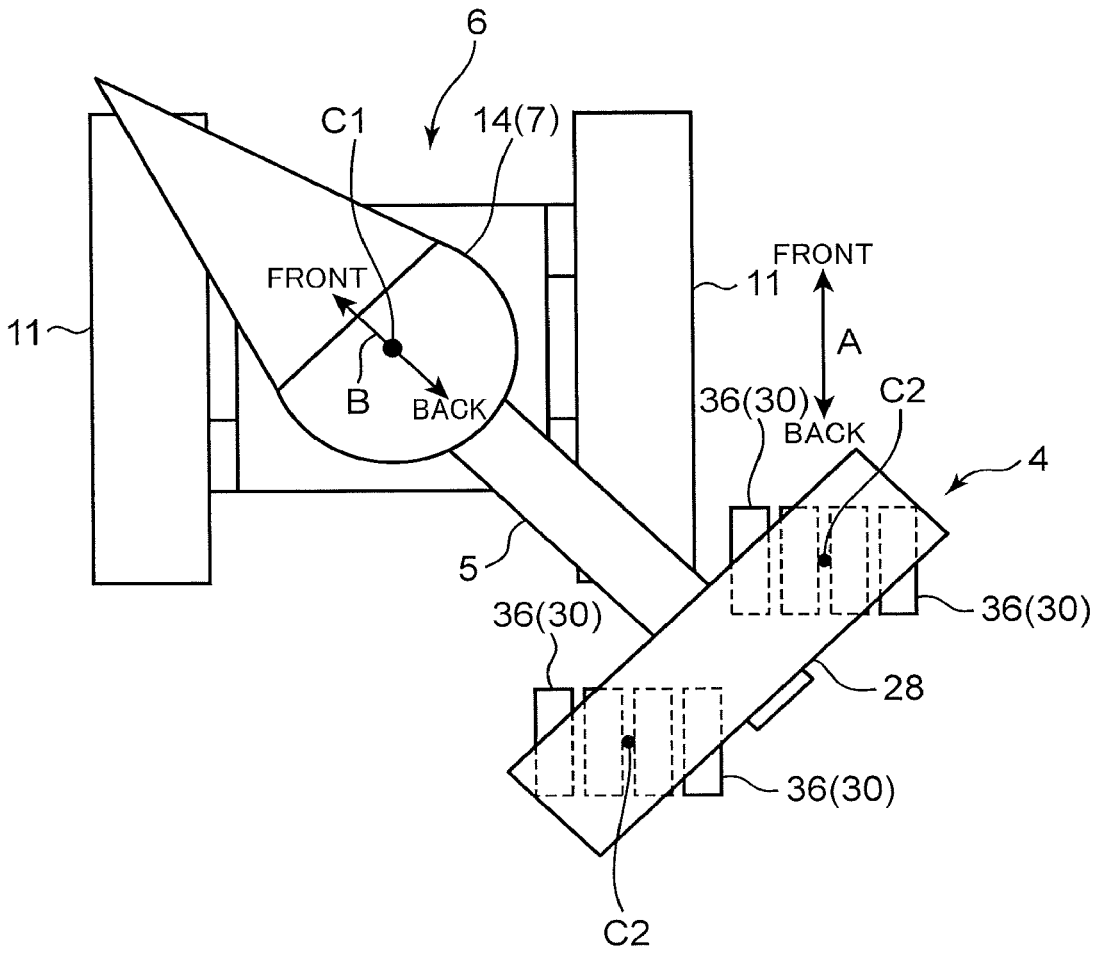
FIG. 5 is a schematic view of the mobile crane when seen from the upper side thereof in a state in which the upper swing body has a swing-angle of 45° and the wheel units take the traveling posture.
Figure 6:
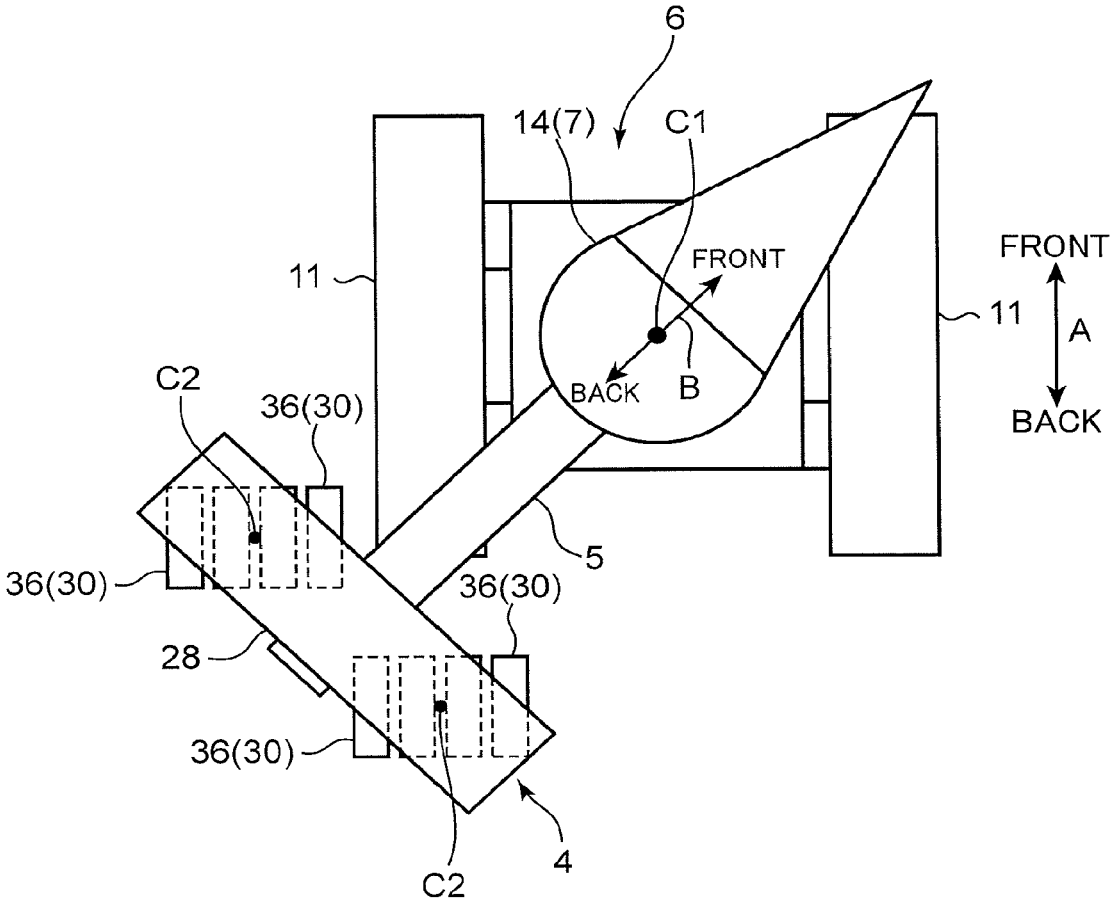
FIG. 6 is a schematic view of the mobile crane when seen from the upper side thereof in a state in which the upper swing body has a swing-angle of 315° and the wheel units take the traveling posture.
Figure 7:
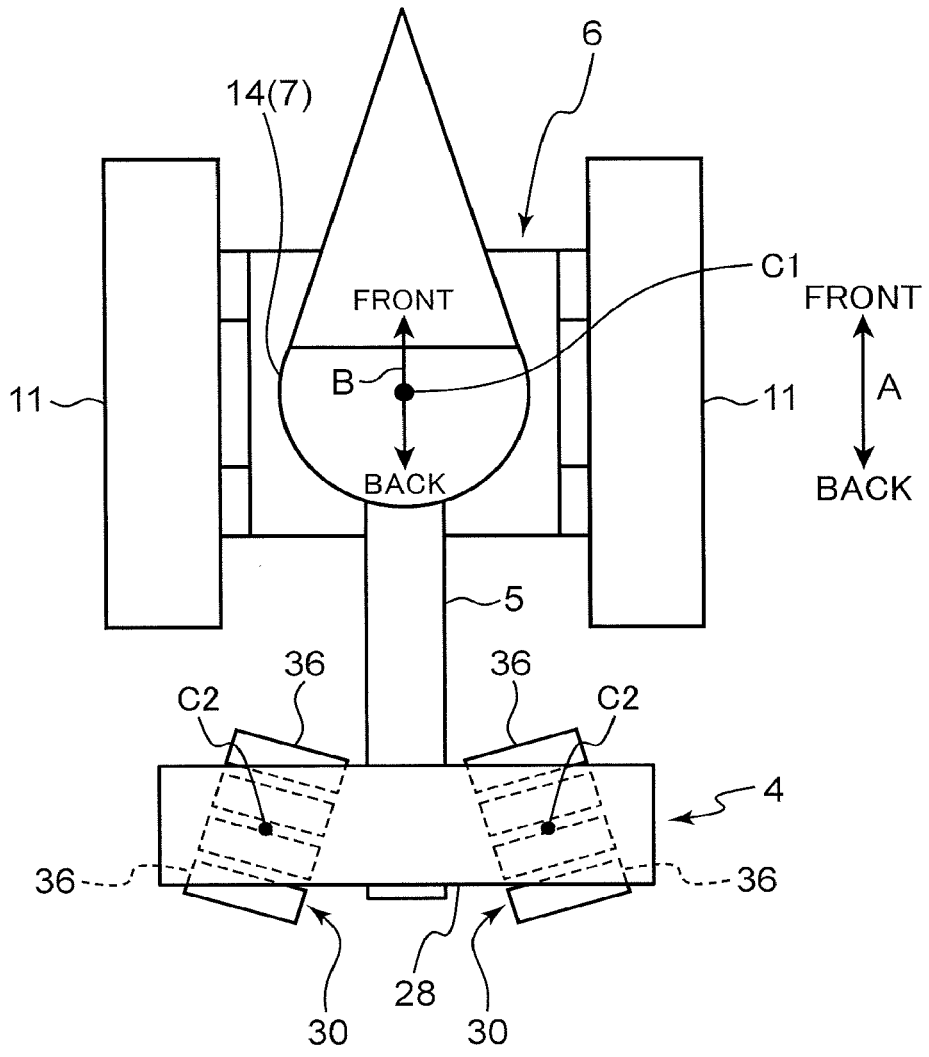
FIG. 7 is a schematic view of the mobile crane when seen from the upper side thereof in a state in which the wheel units take a swing posture.
Figure 8:
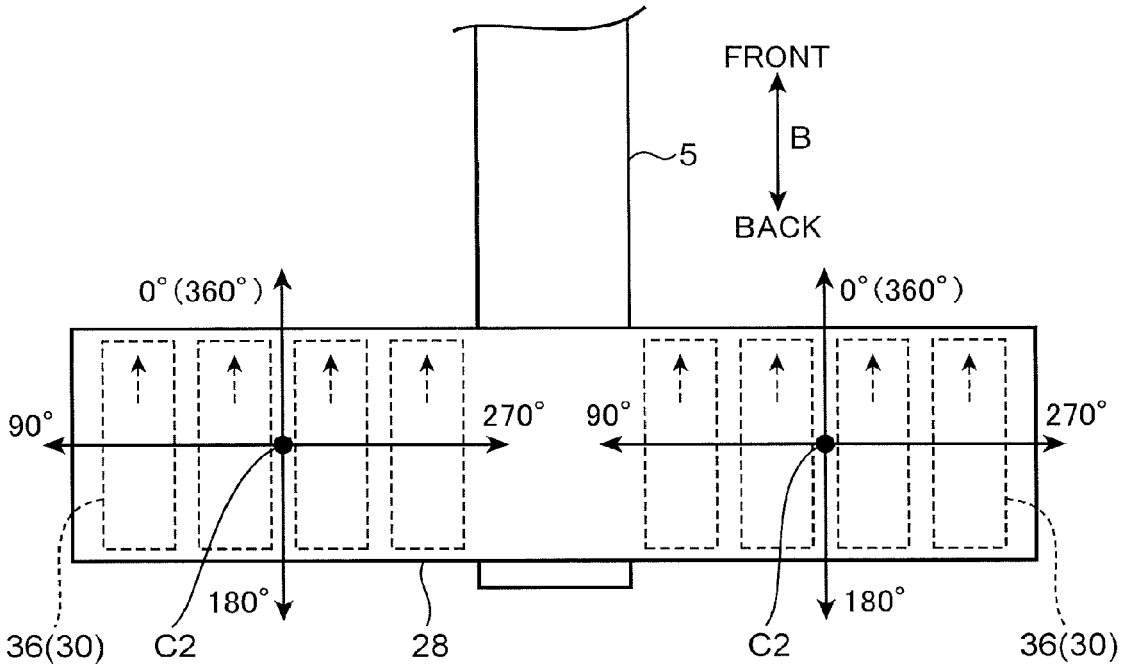
FIG. 8 is a view for describing a steering angle of the wheel units of the counterweight carrier.

The lower traveling body 6 (see FIG. 1) is of a crawler type and configured to be capable of being self-traveling in its front-back direction A (see FIGS. 4 to 6). The lower traveling body 6 is provided with a pair of crawler devices 11 separately arranged on both sides (both right and left sides) in its width direction. By the driving of the pair of crawler devices 11, the lower traveling body 6 is caused to be self-propelled. Note that the front-back direction A of the lower traveling body 6 is a direction corresponding to the longitudinal direction of each of the crawler devices 11.

The traveling operation device 9 (see FIG. 9) is configured to issue an instruction for causing the crane main-body 3 to travel (move forward or backward) or stop traveling. The traveling operation device 9 is provided inside the operation room (not shown) of the upper swing body 7. The traveling operation device 9 is provided with a traveling operation lever 9*a* configured to be operated to issue an instruction for causing the lower traveling body 6 to travel forward or backward. The traveling operation lever 9*a* is an example of a traveling operation section according to the present invention. Hereinafter, the traveling operation lever 9*a* will be simply called a lever 9*a*.

The lever 9*a* may be configured to be operated to tilt between a neutral position, a forward-movement position, and a backward-movement position. The neutral position represents a position at which the lower traveling body 6 is instructed to stop traveling. The forward-movement position represents a position on one side relative to the neutral position, i.e., a position at which the lower traveling body 6 is instructed to travel forward. The backward-movement position is a position on the side opposite to the one side relative to the neutral position, i.e., a position at which the lower traveling body 6 is instructed to travel backward. In response that the lever 9*a* is operated from the neutral position to the forward-movement position, the crawler devices 11 drive the lower traveling body 6 forward. In addition, in response that the lever 9*a* is operated from the neutral position to the backward-movement position, the crawler devices 11 drive the lower traveling body 6 backward.

The upper swing body 7 (see FIG. 1) is mounted on the lower traveling body 6 to be capable of swinging about a vertical axis C1. As shown in FIG. 1, the upper swing body 7 is provided with an upper swing body main body 14 attached on the lower traveling body 6 to be capable of swinging, a boom 16 and a mast 18 attached to the upper swing body main body 14, and a hanging tool 20 used to hang a hanging load.

The boom 16 is attached at the front end of the upper swing body main body 14 so as to freely rise and fall. The hanging tool 20 hangs down from the tip end of the boom 16.

The mast 18 is attached to the upper swing body main body 14 so as to be rotatable about a horizontal axis with its base end (lower end) set as a fulcrum at a position behind the boom 16. The tip end (upper end) of the mast 18 is connected to the tip end of the boom 16 via a boom guy line 22. Thus, the mast 18 supports the boom 16 in a standing state via the boom guy line 22 from behind. In addition, the tip end of the mast 18 is connected to the carrier 4 via a carrier guy line 24.

Note that the "front side" of the upper swing body 7, the carrier 4, and the coupling beam 5 represents a side where the boom 16 of the upper swing body 7 is provided, while the "rear side" of the upper swing body 7, the carrier 4, and the coupling beam 5 represents a side opposite to the side where the boom 16 is provided. Directions shown in FIGS. 4 to 6 by both arrows B correspond to the front-back direction of the upper swing body 7, the carrier 4, and the coupling beam 5.

The swing-body driving device 8 (see FIG. 9) is a device that clews the upper swing body 7 (the upper swing body main body 14) about the vertical axis C1 according to an operation of a swing operation lever 10*a* (that will be described later) of the swing operation device 10. The swing-body driving device 8 has a swing motor serving as a hydraulic motor and a transmission mechanism. The transmission mechanism is configured to transmit power output from the swing motor between the lower traveling body 6 and the upper swing body main body 14 to slew the upper swing body main body 14 relative to the lower traveling body 6.

The swing operation device 10 (see FIG. 9) is configured to issue an instruction for causing the upper swing body 7 to swing or stop swinging. The swing operation device 10 is provided inside the operation room (not shown) of the upper swing body 7. The swing operation device 10 is provided with the swing operation lever 10*a* configured to be operated to issue an instruction for causing the upper swing body 7 to slew clockwise or counterclockwise. Hereinafter, the swing operation lever 10*a* will be simply called a lever 10*a*.

The lever 10*a* may be configure to be operated to tilt between a neutral position, a clockwise swing position, and a counterclockwise swing position. The neutral position represents a position at which the upper swing body 7 is instructed to stop swinging. The clockwise swing position represents a position on one side relative to the neutral position, i.e., a position at which the upper swing body 7 is instructed to slew clockwise. The counterclockwise swing position represents a position on a side opposite to the one side relative to the neutral position, i.e., a position at which the upper swing body 7 is instructed to slew counterclockwise. In response that the lever 10*a* is operated from the neutral position to the clockwise swing position, the swing-body driving device 8 slews the upper swing body 7 clockwise. In addition, in response that the lever 10*a* is operated from the neutral position to the counterclockwise swing position, the swing-body driving device 8 slews the upper swing body 7 counterclockwise.

The swing-angle detecting section 25 (see FIG. 9) is configured to detect a swing angle of the upper swing body 7 about the vertical axis C1 relative to the lower traveling body 6. The swing-angle detecting section 25 detects a swing angle of the upper swing body 7 point by point and transmits data on the detected swing angle to a main-body-side controller 82 (that will be described later) point by point. A swing angle of the upper swing body 7 detected by the swing-angle detecting section 25 is defined as follows (see FIGS. 4 to 6).

It is assumed that the upper swing body 7 has a swing angle of 0° in a state in which a front-back direction B of the upper swing body 7 corresponds to the front-back direction A of the lower traveling body 6 (see FIG. 4), i.e., a state in which the front side of the upper swing body 7 corresponds to the front side of the lower traveling body 6 and the back side of the upper swing body 7 corresponds to the back side of the lower traveling body 6. It is assumed that the swing angle increases as the upper swing body 7 slews counterclockwise in a state in which the upper swing body 7 has a swing-angle of 0°. A state where the upper swing body 7 makes a complete turn from a swing-angle of 0° back to a swing-angle of 0° is regarded that the upper swing body 7 has a swing-angle of 360°. Accordingly, the upper swing body 7 has a swing-angle of 45° when put in the state of FIG. 5, and has a swing-angle of 315° when put in the state of FIG. 6. Furthermore, the upper swing body 7 has a swing-angle of 180° in a state in which the upper swing body 7 faces exactly an opposite direction to the state in which the upper swing body 7 has a swing-angle of 0°, i.e., a state in which the front side of the upper swing body 7 corresponds to the back side of the lower traveling body 6 and the back side of the upper swing body 7 corresponds to the front side of the lower traveling body 6.

The coupling beam 5 extends from the upper swing body 7 (the upper swing body main body 14) to the back side of the upper swing body 7. The coupling beam 5 is coupled to the back end of the upper swing body main body 14. The coupling beam 5 projects from the back end of the upper swing body main body 14 and extends to the back side along the front-back direction B of the upper swing body main body 14.

The carrier 4 (see FIG. 1) is arranged at a position distant from the upper swing body 7 on the back side of the upper swing body 7. The carrier 4 is capable of moving (being self-propelled) according to the movement of the crane main-body 3 (the traveling of the crane main-body 3 or the swing of the upper swing body 7). The carrier 4 has a counterweight 27 mounted on it and is coupled to the tip end of the mast 18 via the carrier guy line 24 as described above while being coupled to the back side of the upper swing body main body 14 via the coupling beam 5, thereby balancing with a hanging load on the front side of the upper swing body 7, the load of the boom 16, or the like at a hanging operation to increase the stability of the crane 2. Thus, the carrier 4 enhances the hoisting performance of the crane 2.

Figure 2:
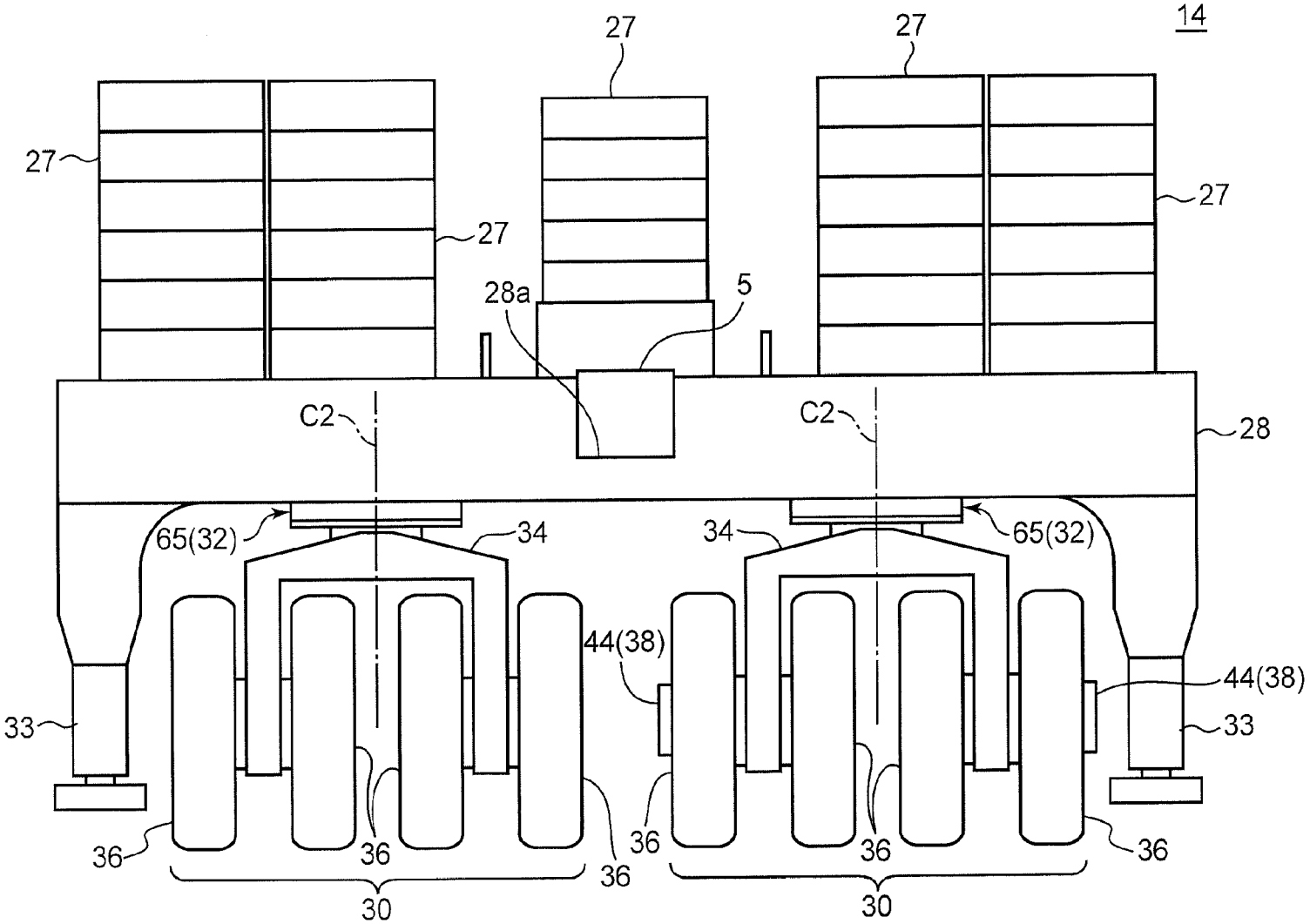
FIG. 2 is a side view of a counterweight carrier when seen from the back side thereof.
Figure 3:
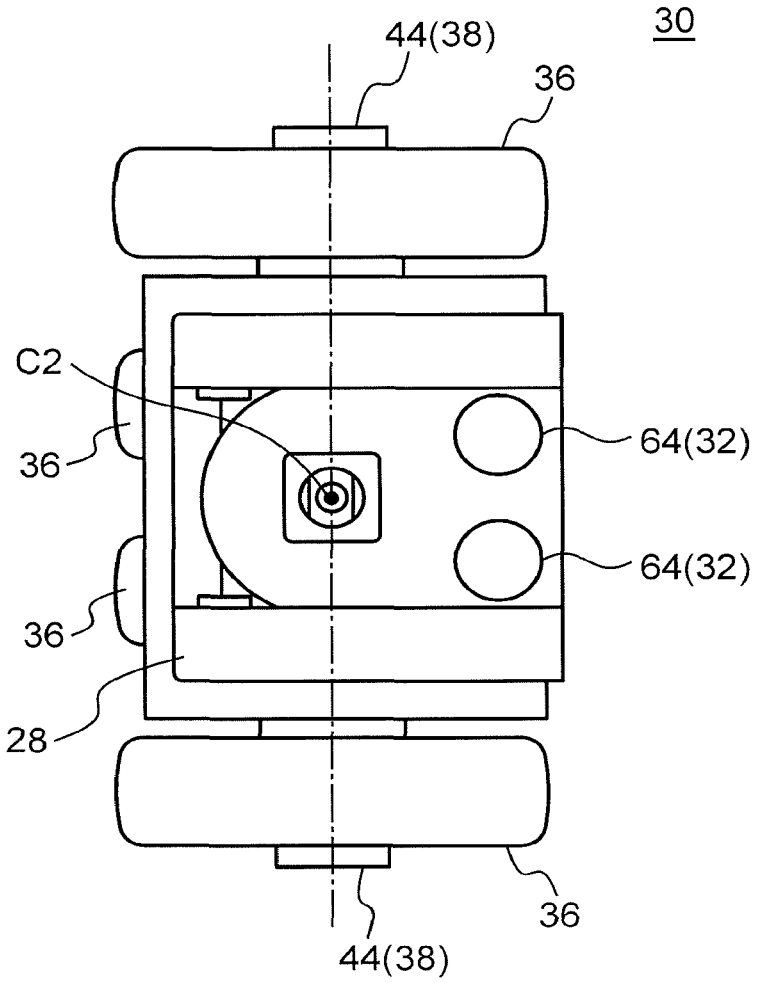
FIG. 3 is a view of a wheel unit when seen from the upper side thereof.
Figure 9:
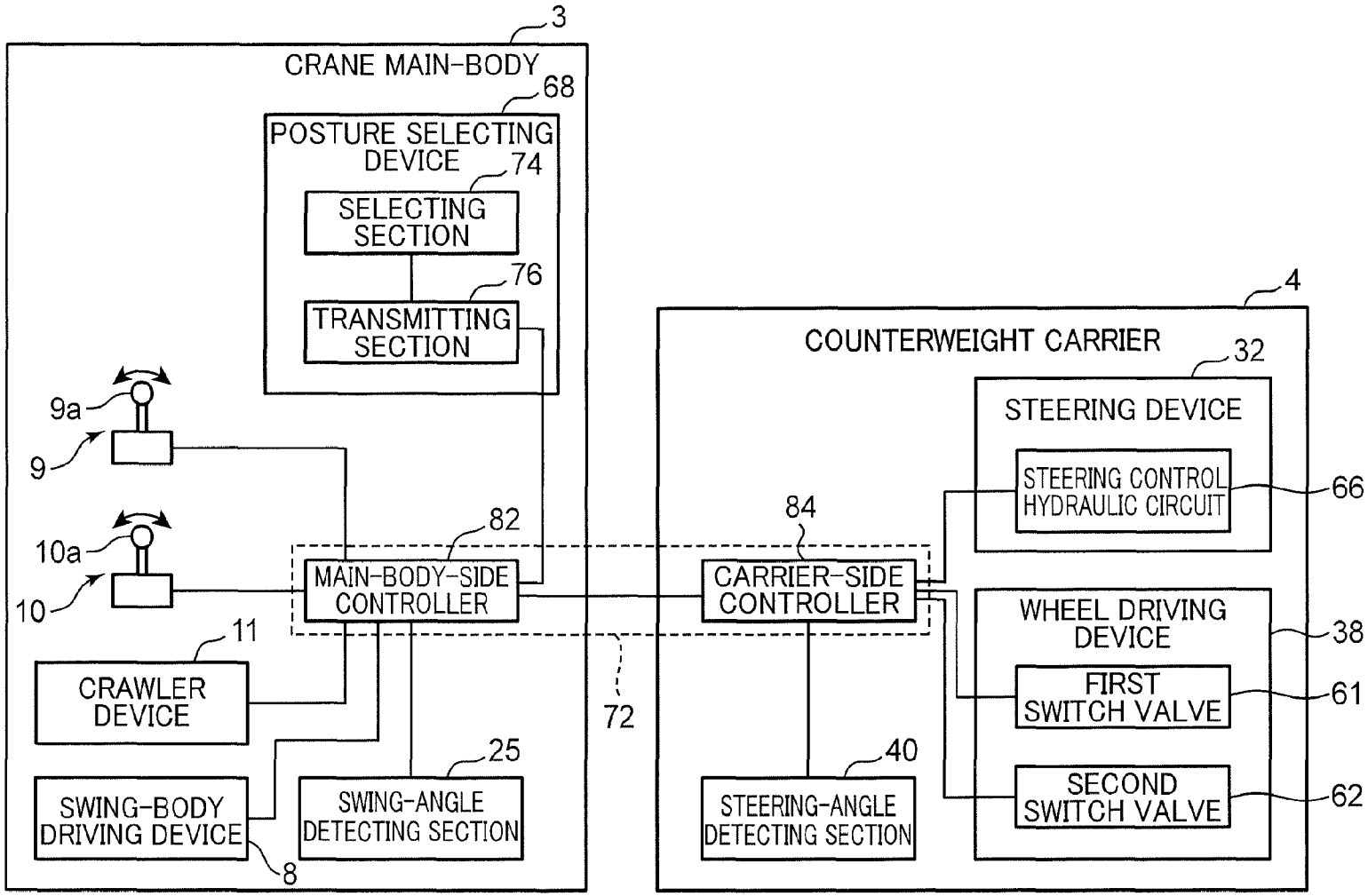
FIG. 9 is a function block diagram of the control system of the mobile crane.

Specifically, as shown in FIG. 2, the carrier 4 has a carrier frame 28, a pair of wheel units 30, a pair of steering devices 32 (see FIGS. 2 and 3), a plurality of jack units 33 (see FIGS. 1 and 2), and a steering-angle detecting section 40 (see FIG. 9).

When seen from its upper side, the carrier frame 28 is formed into a substantially rectangular shape long in the right-left width direction of the upper swing body main body 14. The carrier frame 28 is arranged such that its center in the right-left width direction corresponds to the center in the right-left width direction of the upper swing body main body 14. That is, the carrier frame 28 is arranged such that its center in the right-left width direction corresponds to the center in the right-left width direction of the coupling beam 5. In this state, the carrier frame 28 is coupled to the coupling beam 5. The counterweight 27 (see FIG. 1) is mounted on the carrier frame 28.

The pair of wheel units 30 is attached to the carrier frame 28. The pair of wheel units 30 is arranged beneath the carrier frame 28 and separately arranged on both right and left sides of an attachment place 28*a* (see FIG. 2) at which the carrier frame 28 is attached to the coupling beam 5. Each of the wheel units 30 has a unit frame 34 and a plurality of wheels 36.

Each of the unit frames 34 is attached to the carrier frame 28 to be capable of swiveling about a vertical axis C2. The vertical axis C2 about which each of the unit frames 34 swivels corresponds to the swiveling axis of each of the wheel units 30.

The plurality of wheels 36 of each of the wheel units 30 is supported by the unit frame 34 adapted to be rotatable in both directions about a horizontal axis nearly crossing the vertical axis C2. The plurality of wheels 36 is arranged in parallel so as to be coaxial with each other. In the embodiment, each of the wheel units 30 has four wheels 36, and two of the four wheels 36 are each paired.

Figure 10:
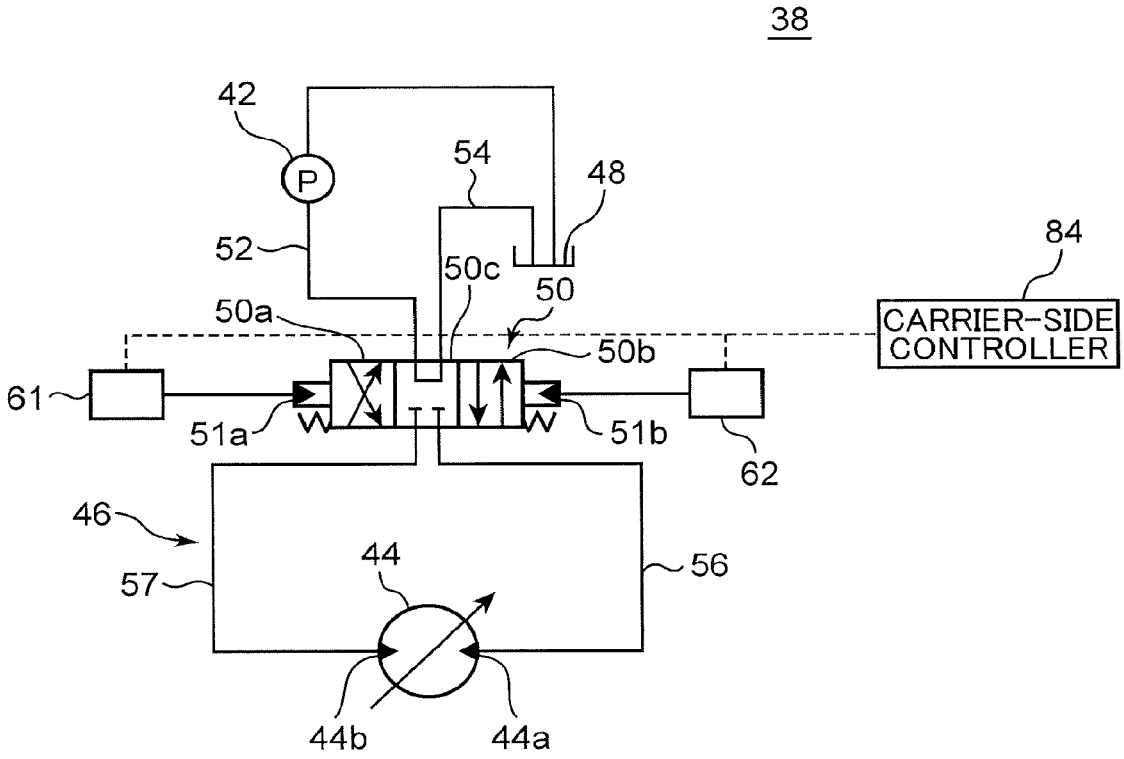
FIG. 10 is a hydraulic-circuit diagram of the wheel driving device of the counterweight carrier.

One of the pair of wheel units 30 has a wheel driving device 38 that rotates the wheels 36 of the wheel unit 30 about their shaft. The wheel driving device 38 is configured to switch between a first driving state in which the wheels 36 are caused to rotate in one rotation direction and a second driving state in which the wheels 36 are caused to rotate in a direction opposite to the one rotation direction. As shown in FIG. 10, the wheel driving device 38 is provided with a hydraulic pump 42, a hydraulic motor 44, and a hydraulic circuit 46.

The hydraulic pump 42 is configured to eject hydraulic oil to be supplied to the hydraulic motor 44.

The hydraulic motor 44 operates with the hydraulic oil supplied from the hydraulic pump 42 and generates power used to rotate the wheels 36. Although the one hydraulic motor 44 is shown in FIG. 10, the wheel driving device 38 may be provided with a plurality of hydraulic motors 44 (see FIG. 2). In this case, configurations that supply and discharge the hydraulic oil to and from the plurality of hydraulic motors 44 are the same. Therefore, the configuration of one of the hydraulic motors 44 will be described as a representative example hereinafter.

The output shaft of the hydraulic motor 44 is connected to the wheel shaft of the corresponding wheels 36. When the hydraulic motor 44 operates and the output shaft rotates, the corresponding wheels 36 rotate. As shown in FIG. 10, the hydraulic motor 44 has a first supply/discharge port 44*a* and a second supply/discharge port 44*b*. The hydraulic motor 44 rotates the wheels 36 in one rotation direction with the hydraulic oil supplied to the first supply/discharge port 44*a*, and rotates the wheels 36 in a rotation direction opposite to the one rotation direction with the hydraulic oil supplied to the second supply/discharge port 44*b*.

The hydraulic circuit 46 (see FIG. 10) is provided with a control valve 50, a supply pipe 52, a return pipe 54, a first conduit 56, a second conduit 57, a first switch valve 61, and a second switch valve 62.

The control valve 50 is a switch valve configured to control the supply state of the hydraulic oil to the hydraulic motor 44. The control valve 50 is connected to the hydraulic pump 42 via the supply pipe 52 and connected to a tank 48 via the return pipe 54. Note that the hydraulic pump 42 and the tank 48 may be provided in any of the carrier 4 and the crane main-body 3. In addition, the control valve 50 is connected to the first supply/discharge port 44*a* of the hydraulic motor 44 via the first conduit 56 and connected to the second supply/discharge port 44*b* of the hydraulic motor 44 via the second conduit 57.

The control valve 50 is configured to be capable of being put in a first supply position 50*a*, a second supply position 50*b*, or a supply stop position 50*c*. When put in the first supply position 50*a*, the control valve 50 connects the supply pipe 52 to the first conduit 56 while connecting the return pipe 54 to the second conduit 57. When put in the second supply position 50*b*, the control valve 50 connects the supply pipe 52 to the second conduit 57 while connecting the return pipe 54 to the first conduit 56. In addition, when put in the supply stop position 50*c*, the control valve 50 does not connect the supply pipe 52 and the return pipe 54 to the first conduit 56 and the second conduit 57.

The control valve 50 has a first pilot port 51*a* and a second pilot port 51*b*. The control valve 50 is configured to be put in the first supply position 50*a* when pilot pressure is supplied to the first pilot port 51*a*. In addition, the control valve 50 is configured to be put in the second supply position 50*b* when the pilot pressure is supplied to the second pilot port 51*b*. Moreover, the control valve 50 is configured to be put in the supply stop position 50*c* when the pilot pressure is not supplied to any of the first and second pilot ports 51*a* and 51*b*.

When put in the first supply position 50*a*, the control valve 50 introduces the hydraulic oil, which has been ejected from the hydraulic pump 42 to the supply pipe 52, into the first conduit 56. Thus, the hydraulic oil is supplied from the first conduit 56 to the first supply/discharge port 44*a* of the hydraulic motor 44. As a result, the hydraulic motor 44 operates the wheels 36 so as to rotate in the one rotation direction, and the hydraulic oil is discharged from the second supply/discharge port 44*b* of the hydraulic motor 44. Accordingly, this state corresponds to the first driving state of the wheel driving device 38. In addition, when put in the first supply position 50*a*, the control valve 50 introduces the hydraulic oil, which has been discharged from the second supply/discharge port 44*b* of the hydraulic motor 44 to the second conduit 57, from the second conduit 57 to the return pipe 54. Thus, the hydraulic oil returns to the tank 48 via the return pipe 54.

In addition, when put in the second supply position 50*b*, the control valve 50 introduces the hydraulic oil, which has been ejected from the hydraulic pump 42 to the supply pipe 52, into the second conduit 57. Thus, the hydraulic oil is supplied from the second conduit 57 to the second supply/discharge port 44*b* of the hydraulic motor 44. As a result, the hydraulic motor 44 operates the wheels 36 so as to rotate in a rotation direction opposite to the one rotation direction, and the hydraulic oil is discharged from the first supply/discharge port 44*a* of the hydraulic motor 44. Accordingly, this state corresponds to the second driving state of the wheel driving device 38. In addition, when put in the second supply position 50*b*, the control valve 50 introduces the hydraulic oil, which has been discharged from the first supply/discharge port 44*a* of the hydraulic motor 44 to the first conduit 56, from the first conduit 56 to the return pipe 54. Thus, the hydraulic oil returns to the tank 48 via the return pipe 54.

Moreover, when put in the supply stop position 50*c*, the control valve 50 cuts off the connection between the supply pipe 52 and the return pipe 54 and the first and second conduits 56 and 57. Thus, the hydraulic oil is not supplied from the hydraulic pump 42 to any of the first supply/discharge port 44*a* and the second supply/discharge port 44*b* of the hydraulic motor 44. As a result, the operation of the hydraulic motor 44 stops, and the application of a rotation driving force to the wheels 36 is not allowed.

The first switch valve 61 is provided on the supply path of the pilot pressure between the first pilot port 51*a* of the control valve 50 and a pilot hydraulic source (not shown). The first switch valve 61 is a solenoid valve that switches between the supply and non-supply of the pilot pressure to the first pilot port 51*a*. In addition, the second switch valve 62 is provided on the supply path of the pilot pressure between the second pilot port 51*b* of the control valve 50 and the pilot hydraulic source (not shown). The second switch valve 62 is a solenoid valve that switches between the supply and non-supply of the pilot pressure to the second pilot port 51*h*.

The first switch valve 61 and the second switch valve 62 are configured to be switchable between an open state and a closed state. The pilot pressure is supplied to the first pilot port 51*a* when the first switch valve 61 is put in the open state. On the other hand, the pilot pressure is not supplied to the first pilot port 51*a* when the first switch valve 61 is put in the closed state. In addition, the pilot pressure is supplied to the second pilot port 51*b* when the second switch valve 62 is put in the open state. On the other hand, the pilot pressure is not supplied to the second pilot port 51*b* when the second switch valve 62 is put in the closed state.

The steering device 32 (see FIG. 2) is attached along each of the pair of wheel units 30. Each of the steering devices 32 is configured to swivel the corresponding wheel unit 30 about the vertical axis C2 relative to the carrier frame 28 to integrally steer the plurality of wheels 36 of the wheel unit 30. Each of the steering devices 32 has a steering motor 64 (see FIG. 3), a steering gear unit 65 (see FIG. 2), and a steering control hydraulic circuit 66 (see FIG. 9).

The steering motor 64 is a hydraulic motor that generates power to steer the wheel unit 30. The steering motor 64 is provided in the carrier frame 28.

The steering gear unit 65 is interposed between the output shaft of the steering motor 64 and the unit frame 34 of the wheel unit 30. The steering gear unit 65 transmits the rotation of the output shaft of the steering motor 64 to the unit frame 34 to swivel the same about the vertical axis C2.

The steering control hydraulic circuit 66 is configured to control the supply of the hydraulic oil to the steering motor 64 to control the operation of the steering motor 64. The steering control hydraulic circuit 66 is provided with the same configuration as that of the hydraulic circuit 46 of the wheel driving device 38. That is, the steering control hydraulic circuit 66 is provided with the same control valve and switch valves as the control valve 50 and the switch valves 61 and 62 of the hydraulic circuit 46. As is the case with the hydraulic circuit 46, the steering control hydraulic circuit 66 uses the switch valves to switch the control valve between a supply position at which the supply of the hydraulic oil to the steering motor 64 is allowed and a supply stop position at which the supply of the hydraulic oil to the steering motor 64 is stopped to control the operation of the steering motor 64.

The plurality of jack units 33 (see FIGS. 1 and 2) is provided in the carrier frame 28. The jack units 33 are units configured to integrally jack up the carrier frame 28 and the pair of wheel units 30. Each of the wheel units 30 is steered in a state in which the wheels 36 are floated in midair by jacking up the carrier frame 28 and the wheel units 30 with the jack units 33. Each of the jack units 33 is provided with a hydraulic cylinder capable of expanding/retracting in a vertical direction. The hydraulic cylinders expand with the hydraulic oil supplied from a hydraulic-oil supply unit (not shown), whereby the jack units 33 perform a jack-up operation.

The steering-angle detecting section 40 (see FIG. 9) is provided for each of the wheel units 30. Each of the steering-angle detecting sections 40 is configured to detect a steering angle of the wheels 36 of the corresponding wheel unit 30 about the vertical axis C2. Each of the steering-angle detecting sections 40 detects a steering angle of the wheels 36 of the corresponding wheel unit 30 point by point and transmits data on the detected steering angle to the main-body-side controller 82 (that will be described later) via a carrier-side controller 84 (that will be described later) point by point. A steering angle of the wheels 36 (the wheel unit 30) detected by the steering-angle detecting section 40 is defined as follows (see FIG. 8).

It is assumed that the wheels 36 (the wheel unit 30) have a steering angle of 0° in a state in which an orientation of the wheels 36 corresponds to the front-back direction B of the upper swing body 7 and a movement direction of the wheels 36 corresponds to the front side of the upper swing body 7 when the wheels 36 are caused to rotate in the one rotation direction by the hydraulic motor 44. Note that the orientation of the wheels 36 corresponds to a direction perpendicular to both the horizontal axis serving as the rotation center of the wheels 36 and the vertical axis C2 serving as the swiveling center of the wheel unit 30. In addition, it is assumed that the steering angle increases as the wheel unit 30 is steered about the vertical axis C2 in a state in which the wheel unit 30 has a steering angle of 0°. Further, it is assumed that the wheel unit 30 has a steering angle of 360° when making a round from the state in which the wheel unit 30 has a steering angle of 0° to take the same posture as the posture in which the wheel unit 30 has a steering angle of 0°. Accordingly, the wheels 36 (the wheel unit 30) have a steering angle of 180° in a state in which an orientation of the wheels 36 corresponds to the front-back direction B of the upper swing body 7 and a movement direction of the wheels 36 corresponds to the back side of the upper swing body 7 when the wheels 36 are caused to rotate in the one rotation direction. That is, the wheels 36 (the wheel unit 30) has a steering angle of 180° in a state in which a movement direction of the wheels 36 corresponds to the back side of the upper swing body 7 when the wheels 36 are caused to rotate in the opposite rotation direction by the hydraulic motor 44.

In addition, the crane 2 according to the embodiment is provided with a posture selecting device 68 and a controller 72 (see FIG. 9).

The posture selecting device 68 is used to cause an operator to select a posture of each of the wheel units 30 of the carrier 4 about the vertical axis C2. The posture selecting device 68 is provided in the crane main-body 3. By the posture selecting device 68, the operator is allowed to select, for example, a traveling posture (see FIGS. 4 to 6) or a swing posture (see FIG. 7) as a posture of the wheel unit 30.

The traveling posture (see FIGS. 4 to 6) represents the specific posture of the wheel unit 30 with respect to the crane main-body 3 which the wheel unit 30 takes by swiveling about the vertical axis C2. The traveling posture is set at the traveling of the crane main-body 3. Specifically, the traveling posture represents a posture in which an orientation of each of the wheels 36 of the wheel unit 30 corresponds to the front-back direction A of the lower traveling body 6. The traveling posture of the wheel unit 30 is different depending on a swing state of the upper swing body 7. For example, as shown in FIG. 4, the traveling posture of the wheel unit 30 when the upper swing body 7 is put in a swing state in which the front-back direction B of the upper swing body 7 corresponds to the front-back direction A of the lower traveling body 6 is such that an orientation of each of the wheels 36 of the wheel unit 30 corresponds to the front-back direction A of the lower traveling body 6 and the front-back direction B of the upper swing body 7. Further, as shown in FIGS. 5 and 6, there is a case that the crane 2 travels with the upper swing body 7 put in a swing state in which the front-back direction B of the upper swing body 7 slants relative to the front-back direction A of the lower traveling body 6. In this case, the traveling posture of the wheel units 30 is such that an orientation of each of the wheels 36 of the wheel unit 30 corresponds to the front-back direction A of the lower traveling body 6, while slanting relative to the front-back direction B of the upper swing body 7.

The swing posture (see FIG. 7) represents the posture of the wheel unit 30 set when the upper swing body 7 slews about the vertical axis C1 relative to the lower traveling body 6. At the swing of the upper swing body 7, the carrier 4 slews integrally with the upper swing body 7 about the vertical axis C1. Therefore, in the swing posture, each of the wheels 36 of the wheel unit 30 is arranged in a direction along a swing direction of the carrier 4.

The posture selecting device 68 (see FIG. 9) has a selecting section 74 and a transmitting section 76.

The selecting section 74 is constituted by a selection button or the like configured to be operated to select a posture of the wheel unit 30. The selecting section 74 is an example of a posture instructing section according the present invention. That is, by the operation of the selecting section 74, an instruction for causing the wheel unit 30 (the wheels 36) to take the traveling posture is issued. In addition, by the operation of the selecting section 74, an instruction for causing the wheel unit 30 (the wheels 36) to take the swing posture is issued.

The transmitting section 76 is configured to transmit a signal representing a posture selected by the operation of the selecting section 74 to the controller 72.

The controller 72 is adapted to control the operations of the crane main-body 3 and the carrier 4. When receiving a signal representing the selection of the traveling posture from the transmitting section 76 after the traveling posture is selected by the operation of the selecting section 74, the controller 72 steers the wheel unit 30 such that the wheel unit 30 corresponding to each of the steering devices 32 takes the traveling posture. In this case, the controller 72 causes the steering device 32 to steer the wheel unit 30 such that the wheel unit 30 takes as the traveling posture a posture in which an orientation of the wheels 36 of the wheel unit 30 corresponds to the front-back direction A of the lower traveling body 6 according to a swing state of the upper swing body 7 when an instruction for causing the wheel unit 30 to take the traveling posture is issued by the operation of the selecting section 74. More specifically, the controller 72 causes the steering device 32 to steer the wheel unit 30 by a steering operation that requires a smaller steering amount of the wheel unit 30 between one steering operation and another steering operation, one steering operation being a steering operation in which the steering device 32 swivels the wheel unit 30 in one direction about the vertical axis C2 to make an orientation of each of the wheels 36 of the wheel unit 30 correspond to the front-back direction A of the lower traveling body 6, another steering operation being a steering operation in which the steering device 32 swivels the wheel unit 30 in a direction opposite to the one direction about the vertical axis C2 to make an orientation of each of the wheels 36 of the wheel unit 30 correspond to the front-back direction A of the lower traveling body 6.

In addition, when receiving a signal representing the selection of the swing posture from the transmitting section 76 after the swing posture is selected by the operation of the selecting section 74, the controller 72 causes the wheel unit 30 to be steered such that the wheel unit 30 corresponding to each of the steering devices 32 takes the swing posture.

Moreover, the controller 72 controls each of the crawler devices 11 of the lower traveling body 6 and the wheel driving device 38 of the carrier 4 according to an operation of the lever 9*a*. Specifically, the controller 72 operates each of the crawler devices 11 such that the lower traveling body 6 travels forward in response that the lever 9*a* is operated from the neutral position to the forward-movement position, and operates each of the crawler devices 11 such that the lower traveling body 6 travels backward in response that the lever 9*a* is operated from the neutral position to the backward-movement position.

Further, according to an operation of the lever 9*a*, the controller 72 controls the switching of the driving state of the wheel driving device 38 to put the wheel driving device 38 in a driving state, in which a movement direction of the wheels 36 rotated by the wheel driving device 38 corresponds to the front side of the lower traveling body 6 that represents a traveling direction of the lower traveling body 6, with the driving state being selected between the first driving state and the second driving state.

Furthermore, the controller 72 controls the swing-body driving device 8 according to an operation of the lever 10*a*. Specifically, the controller 72 causes the swing-body driving device 8 to slew the upper swing body 7 clockwise in response that the lever 10*a* is operated from the neutral position to the clockwise swing position. On the other hand, the controller 72 causes the swing-body driving device 8 to slew the upper swing body 7 counterclockwise in response that the lever 10*a* is operated from the neutral position to the counterclockwise swing position.

Specifically, the controller 72 has the main-body-side controller 82 provided in the crane main-body 3 and a carrier-side controller 84 provided in the carrier 4. The main-body-side controller 82 and the carrier-side controller 84 cooperate with each other to realize each of the control operations performed by the controller 72.

Specifically, the main-body-side controller 82 controls the operation of the crawler devices 11 that cause the lower traveling body 6 to travel according to an operation of the lever 9*a*, and controls the operation of the swing-body driving device 8 that causes the upper swing body 7 to slew according to an operation of the lever 10*a*. In addition, the main-body-side controller 82 outputs an instruction signal for causing the carrier 4 to travel according to an operation of the lever 9*a* to the carrier-side controller 84. Moreover, the main-body-side controller 82 outputs an instruction signal for causing the carrier 4 to move in a swing direction of the upper swing body 7 according to an operation of the lever 10*a* to the carrier-side controller 84.

Further, the main-body-side controller 82 outputs an instruction signal for causing the wheel unit 30 of the carrier 4 to take a posture of the wheel unit 30 selected by the selecting section 74 of the posture selecting device 68 to the carrier-side controller 84. When the traveling posture is selected by the selecting section 74, the main-body-side controller 82 selects a steering operation that requires a smaller steering amount between a steering operation in one direction and a steering operation in the other direction about the vertical axis C2 of the wheel unit 30, and adds an instruction signal, which causes the wheel unit 30 to take the traveling posture based on the selected steering operation, to an instruction signal to be output to the carrier-side controller 84.

Furthermore, in a state in which the wheel unit 30 is steered by the steering device 32 to be arranged in the traveling posture in which an orientation of the wheels 36 corresponds to the front-back direction of the lower traveling body 6, the main-body-side controller 82 specifies, based on a swing-angle detected by the swing-angle detecting section 25 and a steering angle detected by the steering-angle detecting section 40, a rotation direction of the wheels 36 in which a movement direction of the wheels 36 of the carrier 4 corresponds to a traveling direction of the lower traveling body 6 instructed by an operation of the lever 9*a*. Then, the main-body-side controller 82 outputs an instruction signal for causing the wheels 36 to rotate in the specified rotation direction to the carrier-side controller 84.

When receiving an instruction signal for causing the carrier 4 to travel, from the main-body-side controller 82, the carrier-side controller 84 causes the wheel driving device 38 to rotate the wheels 36 such that the carrier 4 is caused to travel as instructed by the instruction signal. In addition, when receiving an instruction signal for causing the carrier to move in the swing direction from the main-body-side controller 82, the carrier-side controller 84 causes the wheel driving device 38 to rotate the wheels 36 such that the carrier 4 is caused to move as instructed by the instruction signal. Moreover, when receiving an instruction signal for causing the wheel unit 30 to take a posture from the main-body-side controller 82, the carrier-side controller 84 causes the steering device 32 to steer the wheel unit 30 by a steering operation instructed by the instruction signal such that the wheel unit 30 takes a posture as instructed by the instruction signal. Further, when the wheel unit 30 rotates the wheels 36 to cause the carrier 4 put in the traveling state to travel, the carrier-side controller 84 causes the wheel driving device 38 to rotate the wheels 36 in a rotation direction as instructed by an instruction signal from the main-body-side controller 82.

The specific contents of the control operations performed by the main-body-side controller 82 and the carrier-side controller 84 will be described in detail in the following descriptions of processes.

A description will be given, with reference to the flowcharts of FIGS. 11 and 12, of the process of changing a posture of the wheel unit 30 when the traveling posture is selected as a posture of the wheel unit 30 of the carrier 4.

Figure 11:
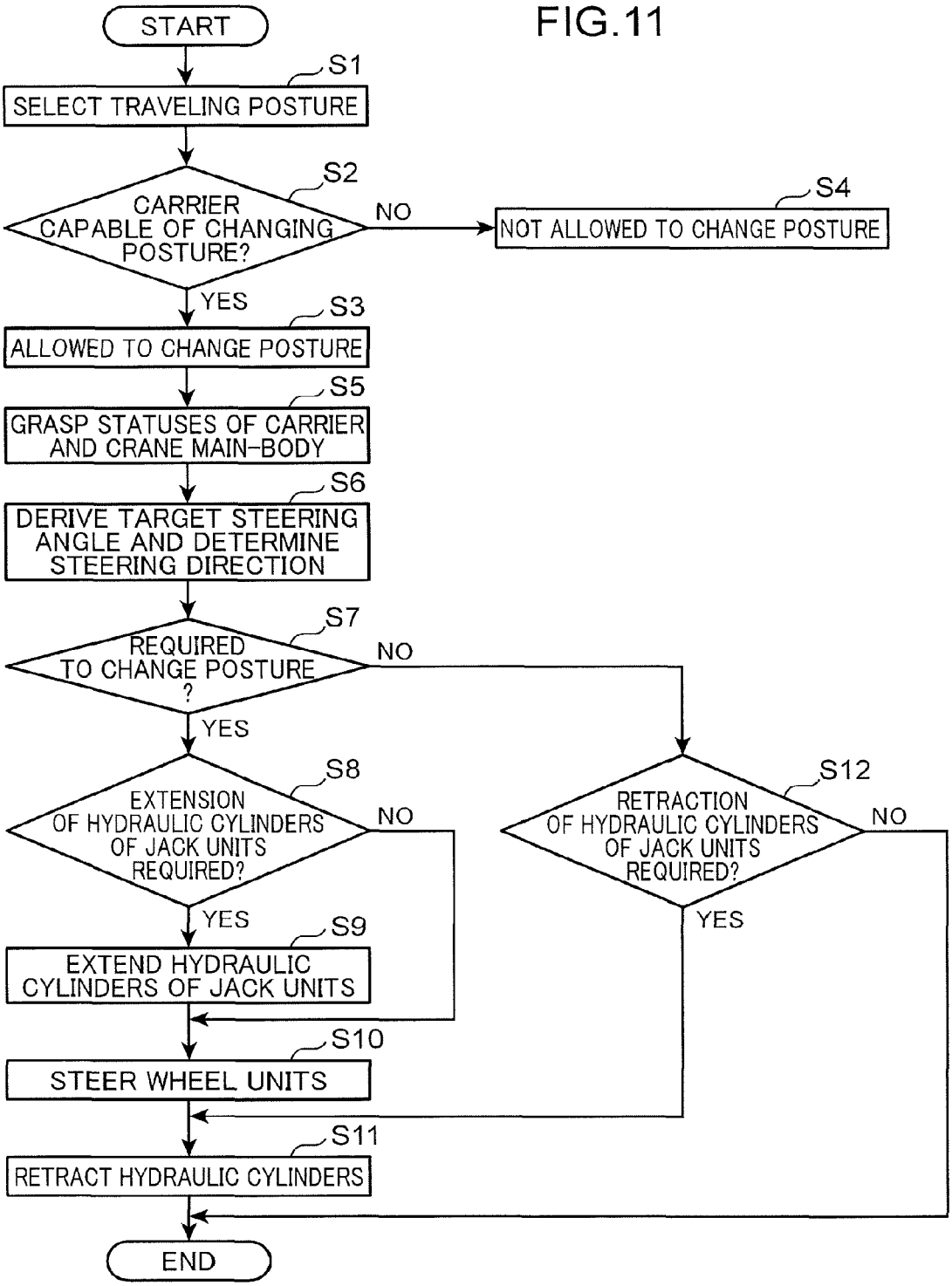
FIG. 11 is a flowchart showing the process of changing a posture of the wheel units of the counterweight carrier into the traveling posture.

First, when an operator operates the selecting section 74 of the posture selecting device 68, the traveling posture is selected as a posture of the wheel unit 30 (step S1 in FIG. 11). According to the selection of the traveling posture, the transmitting section 76 transmits a signal representing the selection of the traveling posture to the main-body-side controller 82.

Next, the main-body-side controller 82 determines whether the carrier 4 is put in a state in which the carrier 4 is capable of changing its posture (step S2). Specifically, the main-body-side controller 82 determines whether the carrier 4 has a failure due to which the carrier 4 is not capable of changing its posture. When the carrier 4 does not have such a failure, the main-body-side controller 82 deter mines that the carrier 4 is capable of changing its posture. On the other hand, when the carrier 4 has a failure, the main-body-side controller 82 determines that the carrier 4 is not capable of changing its posture. The main-body-side controller 82 acquires information as to whether the carrier 4 has a failure from the carrier-side controller 84 and makes the determination based on the information.

When the main-body-side controller 82 determines that the carrier 4 is put in a state in which the carrier 4 is capable of changing its posture, the carrier 4 is allowed to change the posture (step S3). On the other hand, when the main-body-side controller 82 determines that the carrier 4 is not capable of changing its posture, the carrier 4 is not allowed to change the posture (step S4).

When the carrier 4 is allowed to change its posture, the main-body-side controller 82 then grasps a current state of the carrier 4 and a current state of the crane main-body 3 (step S5).

Specifically, as a current state of the carrier 4, the main-body-side controller 82 grasps a current steering angle of each of the wheel units 30 and an expansion/retraction state of the hydraulic cylinder of each of the jack units 33. The current steering angle of each of the wheel units 30 is detected by the steering-angle detecting section 40. The main-body-side controller 82 receives data on the detected steering angle from the steering-angle detecting section 40 via the carrier-side controller 84 to grasp the steering angle of each of the wheel units 30 (the wheels 36). In addition, data on the expansion/retraction state of the hydraulic cylinder of each of the jack units 33 is acquired by the carrier-side controller 84. The main-body-side controller 82 receives the acquired data on the expansion/retraction state from the carrier-side controller 84 to grasp the expansion/retraction state of the hydraulic cylinder of each of the jack units 33.

In addition, as a current state of the crane main-body 3, the main-body-side controller 82 grasps a swing-angle of the upper swing body 7. The swing-angle of the upper swing body 7 is detected by the swing-angle detecting section 25. The main-body-side controller 82 receives data on the detected swing-angle from the swing-angle detecting section 25 to grasp the swing-angle of the upper swing body 7.

Figure 13:
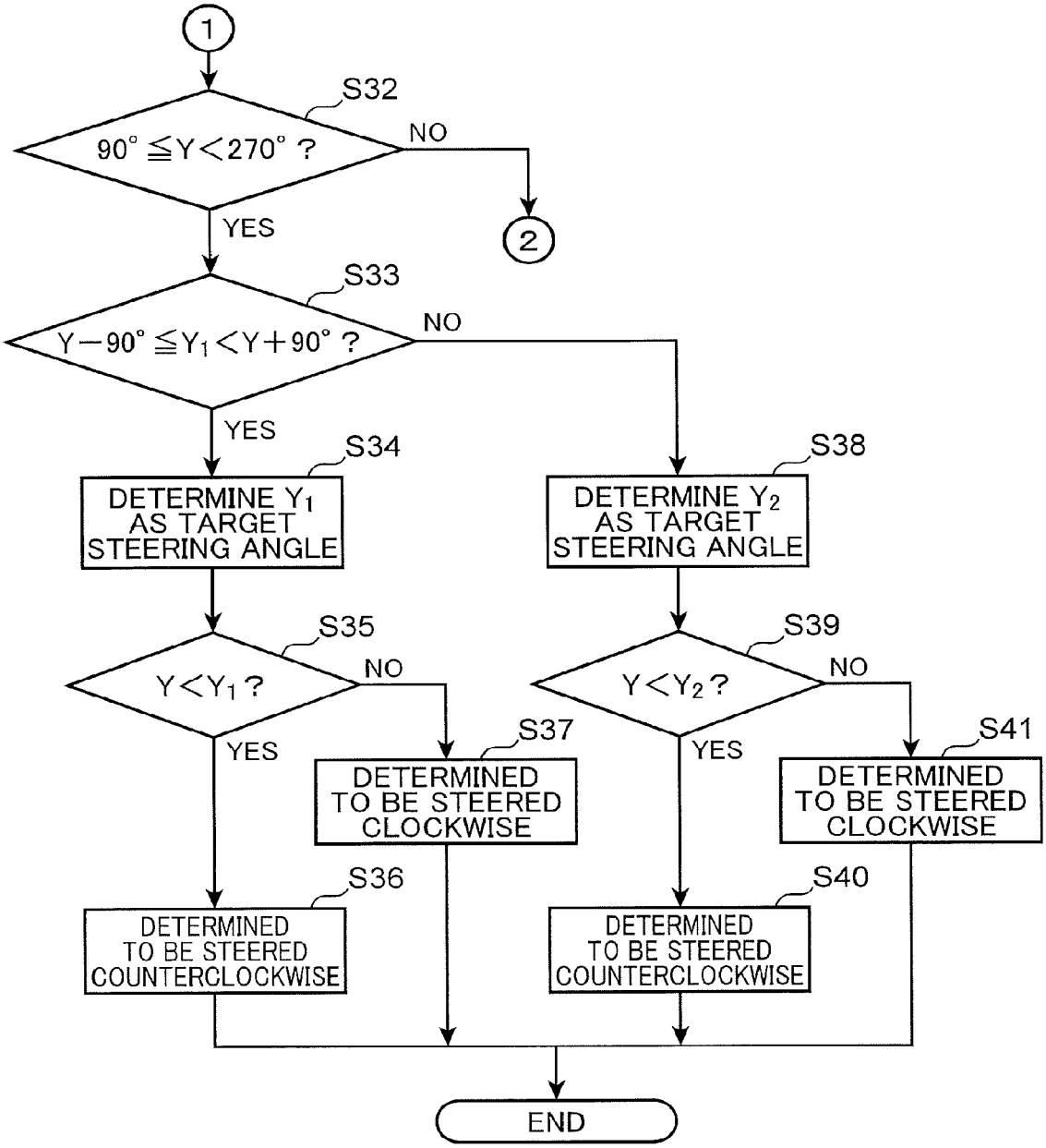
FIG. 13 is a flowchart showing the process of deriving a target steering angle of the wheel units and the process of determining a steering direction of the wheel units when the posture of the wheel units is changed into the traveling posture.
Figure 14:
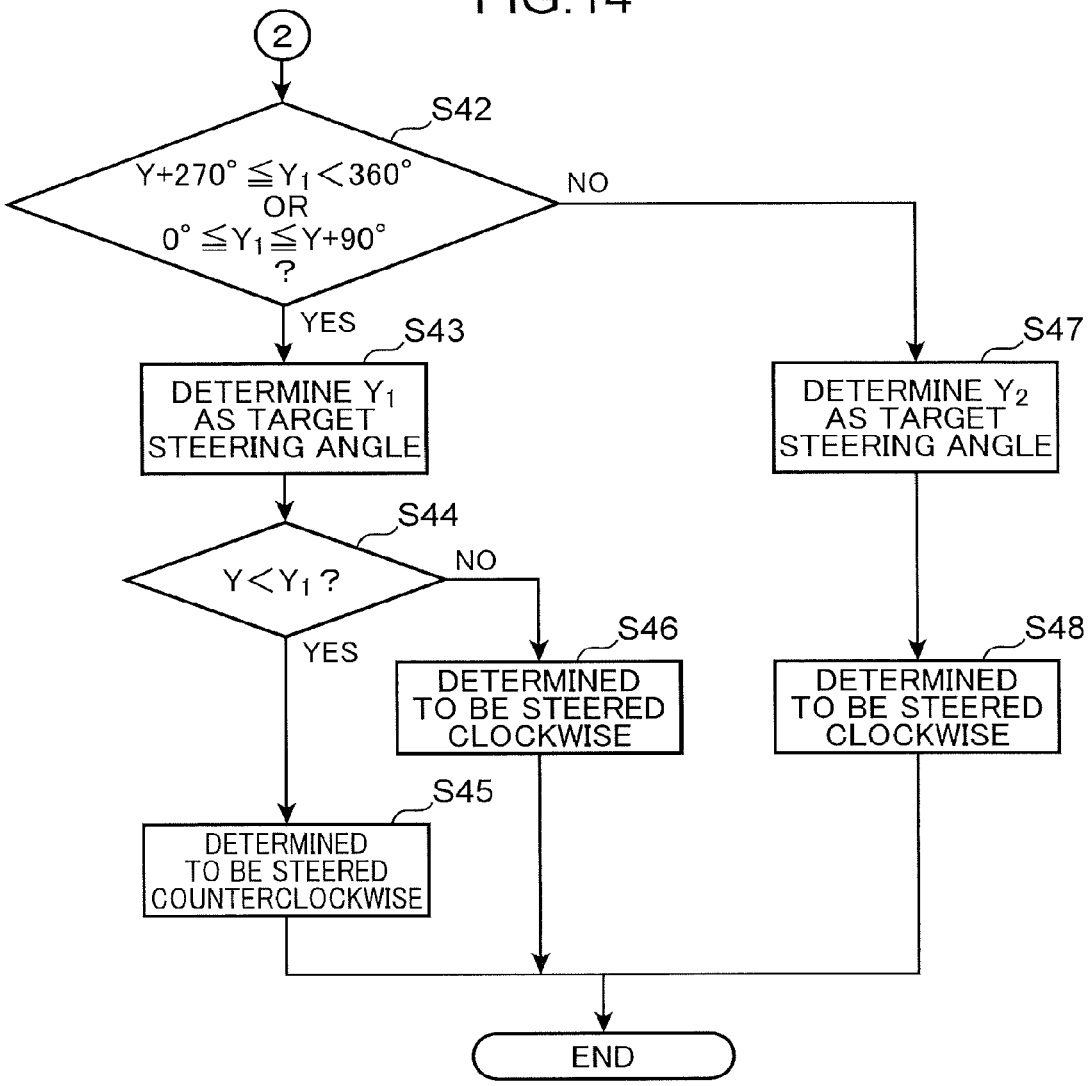
FIG. 14 is a flowchart showing the process of deriving a target steering angle of the wheel units and the process of determining a steering direction of the wheel units when the posture of the wheel units is changed into the traveling posture.

Next, the main-body-side controller 82 derives a target steering angle of each of the wheel units 30 and determines a steering direction of each of the wheel units 30 such that each of the wheel units 30 is put in the traveling state corresponding to the swing state (swing-angle) of the upper swing body 7 (step S6). The specific process of deriving the target steering angle and determining the steering direction is shown in the flowcharts of FIGS. 12 to 14.

Figure 12:
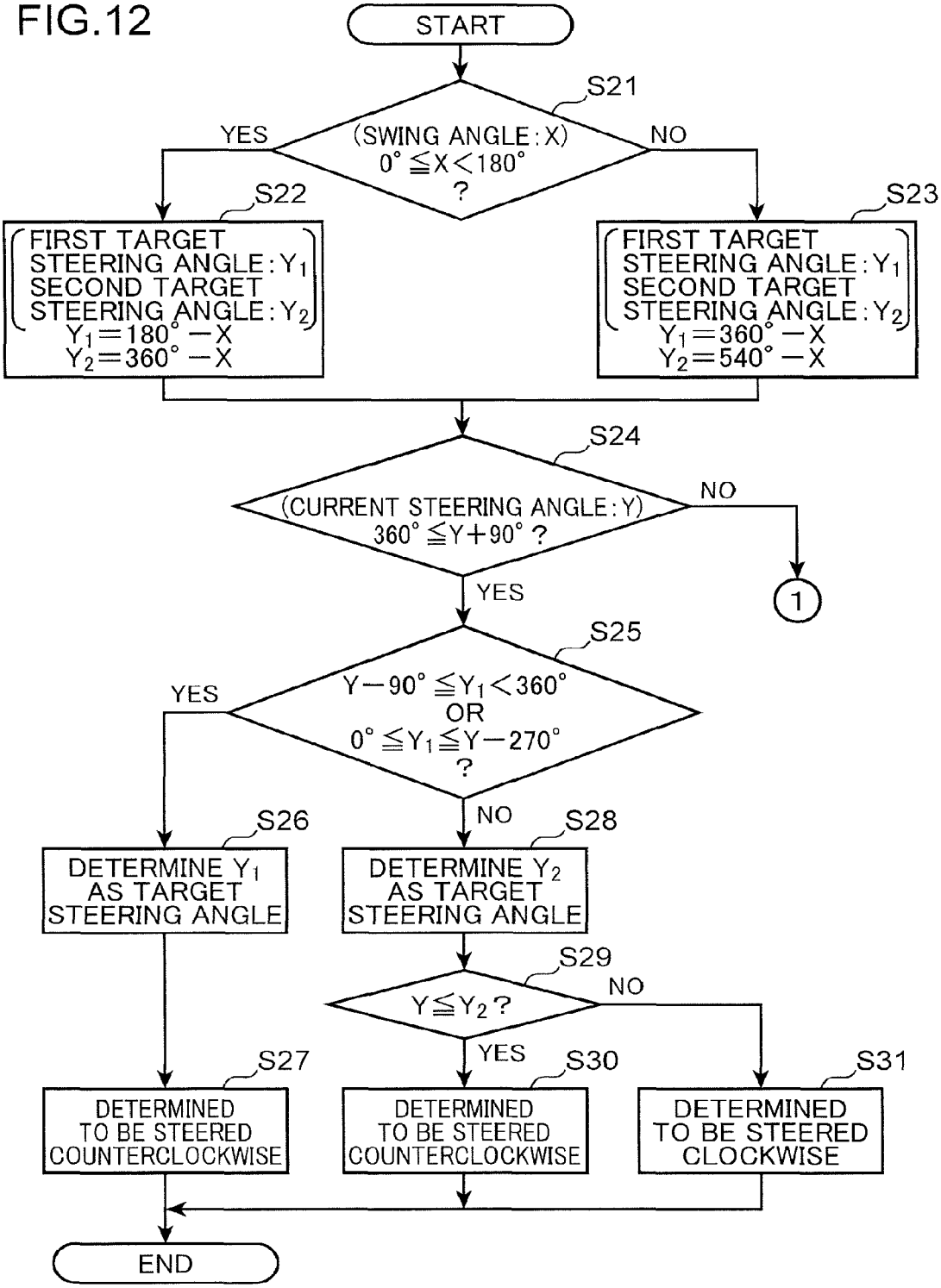
FIG. 12 is a flowchart showing the process of deriving a target steering angle of the wheel units and the process of determining a steering direction of the wheel units when the posture of the wheel units is changed into the traveling posture.

In this process, the main-body-side controller 82 determines whether a swing-angle X of the upper swing body 7 grasped in step S5 is greater than or equal to 0° and less than 180° (step S21 in FIG. 12).

When determining that the swing-angle X is greater than or equal to 0° and less than 180°, the main-body-side controller 82 calculates a first target steering angle $Y_1$ and a second target steering angle $Y_2$ as temporary target steering angles according to the following formulae (1) and (2) (step S22).

$$Y_1=180°-X \tag{1}$$

$$Y_2=360°-X \tag{2}$$

On the other hand, when determining in step S21 that the swing-angle X is not greater than or equal to 0° and less than 180°, the main-body-side controller 82 calculates a first target steering angle $Y_1$ and a second target steering angle $Y_2$ as temporary target steering angles according to the following formulae (3) and (4) (step S23).

$$Y_1=360°-X \tag{3}$$

$$Y_2=540°-X \tag{4}$$

After step S22 or S23, the main-body-side controller 82 determines whether a value obtained by adding 90° to a current steering angle Y of the wheel unit 30 (hereinafter simply called a current steering angle Y) grasped in step S5 is greater than or equal to 360° (step S24).

Here, when determining that the value obtained by adding 90° to the current steering angle Y is greater than or equal to 360°, the main-body-side controller 82 determines whether the previously-calculated first target steering angle $Y_1$ is greater than or equal to a value obtained by subtracting 90° from the current steering angle Y and less than 360° or is greater than or equal to 0° and less than or equal to a value obtained by subtracting 270° from the current steering angle Y (step S25). When YES is determined here, the main-body-side controller 82 finally determines the previously-calculated first target steering angle $Y_1$ as a target steering angle (step S26) and determines the wheel unit 30 (the wheels 36) to be steered counterclockwise (step S27).

On the other hand, when NO is determined in step S25, the main-body-side controller 82 finally determines the previously-calculated second target steering angle $Y_2$ as a target steering angle (step S28). After that, the main-body-side controller 82 determines whether the second target steering angle $Y_2$ is greater than or equal to the current steering angle Y (step S29). Here, the main-body-side controller 82 determines the wheel unit 30 to be steered counterclockwise when determining that the second target steering angle $Y_2$ is greater than or equal to the current steering angle Y (step S30), and determines the wheel unit 30 to be steered clockwise when determining that the second target steering angle $Y_2$ is not greater than or equal to the current steering angle Y (step S31).

In addition, when determining in step S24 that the value obtained by adding 90° to the current steering angle Y is not greater than or equal to 360°, the main-body-side controller 82 then determines whether the current steering angle Y is greater than or equal to 90° and less than 270° (step S32 in FIG. 13). Here, when determining that the current steering angle Y is greater than or equal to 90° and less than 270°, the main-body-side controller 82 determines whether the previously-calculated first target steering angle $Y_1$ is greater than or equal to the value obtained by subtracting 90° from the current steering angle Y and less than the value obtained by adding 90° to the current steering angle Y (step S33). Then, when determining that the first target steering angle $Y_1$ is greater than or equal to the value obtained by subtracting 90° from the current steering angle Y and less than the value obtained by adding 90° to the current steering angle Y, the main-body-side controller 82 finally determines that the first target steering angle $Y_1$ is a target steering angle (step S34). After that, the main-body-side controller 82 determines whether the first target steering angle $Y_1$ is greater than the current steering angle Y (step S35). When determining that the first target steering angle $Y_1$ is greater than the current steering angle Y, the main-body-side controller 82 determines the wheel unit 30 to be steered counterclockwise (step S36). On the other hand, when determining that the first target steering angle $Y_1$ is not greater than the current steering angle Y, the main-body-side controller 82 determines the wheel unit 30 to be steered clockwise (step S37).

In addition, when determining in step S33 that the first target steering angle $Y_1$ is not greater than or equal to the value obtained by subtracting 90° from the current steering angle Y and less than the value obtained by adding 90° to the current steering angle Y, the main-body-side controller 82 finally determines that the second target steering angle $Y_2$ is a target steering angle (step S38). After that, the main-body-side controller 82 determines whether the second target steering angle $Y_2$ is greater than the current steering angle Y (step S39). Then, when determining that the second target steering angle $Y_2$ is greater than the current steering angle Y, the main-body-side controller 82 determines the wheel unit 30 to be steered counterclockwise (step S40). On the other hand, when determining that the second target steering angle $Y_2$ is not greater than the current steering angle Y, the main-body-side controller 82 determines the wheel unit 30 to be steered clockwise (step S41).

Moreover, when determining in step S32 that the current steering angle Y is not greater than or equal to 90° and less than 270°, the main-body-side controller 82 next determines whether the previously-calculated first target steering angle $Y_1$ is greater than or equal to a value obtained by adding 270° to the current steering angle Y and less than 360° or is greater than or equal to 0° and less than or equal to the value obtained by adding 90° to the current steering angle Y (step S42 in FIG. 14). Here, when YES is determined, the main-body-side controller 82 finally determines that the first target steering angle $Y_1$ is a target steering angle (step S43). After that, the main-body-side controller 82 determines whether the first target steering angle $Y_1$ is greater than the current steering angle Y (step S44). Then, when determining that the first target steering angle $Y_1$ is greater than the current steering angle Y, the main-body-side controller 82 determines the wheel unit 30 to be steered counterclockwise (step S45). On the other hand, when determining that the first target steering angle $Y_1$ is not greater than the current steering angle Y, the main-body-side controller 82 determines the wheel unit 30 to be steered clockwise (step S46).

On the other hand, when NO is determined in step S42, the main-body-side controller 82 finally determines that the previously-calculated second target steering angle $Y_2$ is a target steering angle (step S47) and determines the wheel unit 30 to be steered clockwise (step S48).

In the way described above, the main-body-side controller 82 derives a target steering angle of each of the wheel units 30 and determines a steering direction of each of the wheel units 30 such that each of the wheel units 30 is put in the traveling state corresponding to a swing state (swing angle) of the upper swing body 7.

Next, the main-body-side controller 82 determines whether each of the wheel units 30 is required to change its posture (step S7 in FIG. 11). Specifically, when the current steering angle of each of the wheel units 30 grasped in step S5 is different from a target steering angle calculated in the way described above, the main-body-side controller 82 determines that each of the wheel units 30 is required to change its posture. On the other hand, when the current steering angle is equal to the target steering angle, the main-body-side controller 82 determines that each of the wheel units 30 is not required to change its posture.

When determining that each of the wheel units 30 is required to change its posture, the main-body-side controller 82 next determines whether the hydraulic cylinder of each of the jack units 33 is required to extend (step S8).

Specifically, since a posture of the wheel unit 30 is changed by jacking up the carrier 4, the main-body-side controller 82 determines that the hydraulic cylinder of each of the jack units 33 is not required to extend when an expansion/retraction state of the hydraulic cylinder of each of the jack units 33 grasped in step S5 represents an expansion state in which the carrier 4 has been jacked up. On the other hand, the main-body-side controller 82 determines that the hydraulic cylinder of each of the jack units 33 is required to extend when an expansion/retraction state of the hydraulic cylinder of each of the jack units 33 grasped in step S5 represents a retraction state in which the carrier 4 has not been jacked up.

When determining that the hydraulic cylinder of each of the jack units 33 is required to extend, the main-body-side controller 82 outputs an instruction signal for causing the hydraulic cylinder to extend to the carrier-side controller 84 so as to cause the carrier-side controller 84 to perform control to supply the hydraulic oil from the hydraulic-oil supply unit to the hydraulic cylinder to thereby extend the hydraulic cylinder of each of the jack units 33 (step S9). Thus, the carrier 4 is jacked up.

Next, the main-body-side controller 82 outputs an instruction signal for causing the wheel unit 30 to be steered to the carrier-side controller 84 so as to cause the carrier-side controller 84 to steer the wheel unit 30 with the steering device 32 (step S10). At this time, the steering device 32 is caused to steer the wheel unit 30 such that the wheel unit 30 is steered in a steering direction determined in the way described above to make a steering angle of the wheel unit 30 correspond to a target steering angle $Y_2$.

When the main-body-side controller 82 determines in step S8 that the hydraulic cylinder of each of the jack units 33 is not required to extend, the steering of the wheel unit 30 in step S10 is performed while skipping the processing of step S9.

Next, the main-body-side controller 82 causes the carrier-side controller 84 to retract the hydraulic cylinder of each of the jack units 33 (step S11). Thus, the carrier 4 descends, and each of the wheels 36 is grounded.

On the other hand, when determining in step S7 that each of the wheel units 30 is not required to change its posture, the main-body-side controller 82 then determines whether the hydraulic cylinder of each of the jack units 33 is required to retract (step S12). In this case, when an expansion/retraction state of the hydraulic cylinder of each of the jack units 33 grasped in step S5 represents a retraction state, the main-body-side controller 82 determines that the hydraulic cylinder of each of the jack units 33 is not required to retract. On the other hand, when an expansion/retraction state of the hydraulic cylinder of each of the jack units 33 grasped in step S5 represents an expansion state, the main-body-side controller 82 determines that the hydraulic cylinder of each of the jack units 33 is required to retract.

When determining that the hydraulic cylinder of each of the jack units 33 is required to retract, the main-body-side controller 82 performs the processing of step S11 to retract the hydraulic cylinder of each of the jack units 33 to move the carrier 4 downward such that each of the wheels 36 is grounded. On the other hand, when the main-body-side controller 82 determines that the hydraulic cylinder of each of the jack units 33 is not required to retract, the process of changing a posture of each of the wheel units 30 is finished.

In the way described above, each of the wheel units 30 of the carrier 4 is steered to take the traveling posture, whereby an orientation of the wheels 36 of each of the wheel units 30 corresponds to the front-back direction A of the lower traveling body 6.

Figure 15:
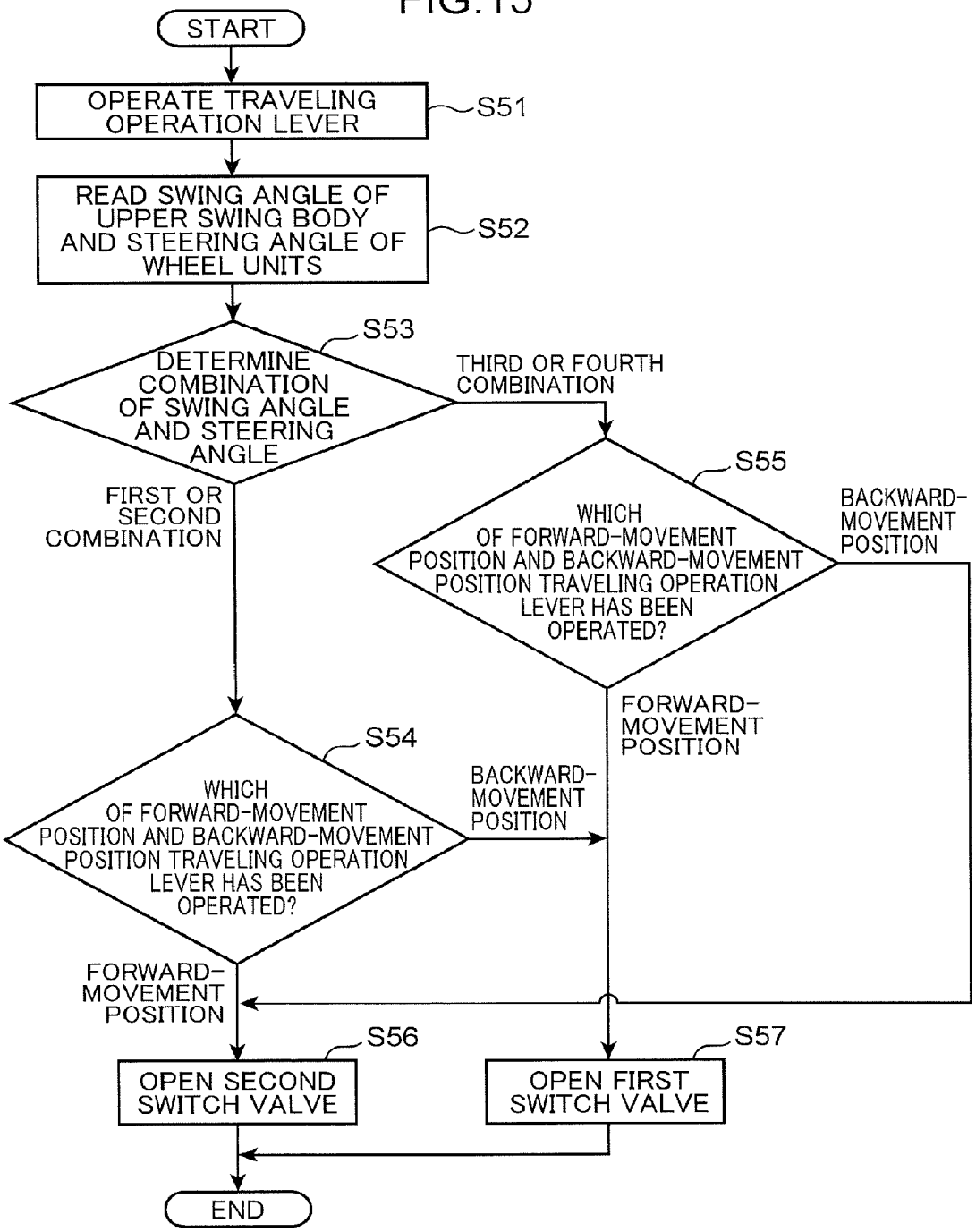
FIG. 15 is a flowchart showing the control process of rotating and driving the wheels of the wheel units in an appropriate rotation direction according to an operation of a traveling operation lever.

After each of the wheel units 30 is steered to take the traveling posture, the traveling of the crane 2 is performed. At this time, a rotation direction of the wheels 36 is controlled such that a movement direction of the wheels 36 of each of the wheel units 30 corresponds to a traveling direction of the lower traveling body 6 instructed by an operation of the lever 9*a*. The control process is shown in the flowchart of FIG. 15. Hereinafter, the control process will be described.

First, the lever 9*a* is operated from the neutral position to the forward-movement position or the backward-movement position (step S51).

After that, the main-body-side controller 82 reads a swing angle of the upper swing body 7 and a steering angle of each of the wheel units 30 (step S52). The swing angle is detected by the swing-angle detecting section 25. In addition, the steering angle is detected by the steering-angle detecting section 40 and set at a value equal to the target steering angle $Y_2$.

Then, the main-body-side controller 82 determines the combination of the read swing angle of the upper swing body 7 and the read steering angle of each of the wheel units 30 (step S53). Specifically, the main-body-side controller 82 determines to which of the following first to fourth combinations the combination of the read swing angle and steering angle corresponds.

A first combination represents a case in which the swing angle is greater than or equal to 0° and less than 180° and the steering angle is greater than 0° and less than or equal to 180°. A second combination represents a case in which the swing angle is greater than or equal to 180° and less than 360° and the steering angle is greater than 180° and less than or equal to 360°. A third combination represents a case in which the swing angle is greater than or equal to 0° and less than 180° and the steering angle is greater than 180° and less than or equal to 360°. A fourth combination represents a case in which the swing angle is greater than or equal to 180° and less than 360° and the steering angle is greater than 0° and less than or equal to 180°.

The first and second combinations correspond to a case in which the wheel unit 30 is arranged to take a posture such that a movement direction of the wheels 36 when the wheels 36 are caused to rotate in the one rotation direction by the hydraulic motor 44 corresponds to the back side of the lower traveling body 6 and such that a movement direction of the wheels 36 when the wheels 36 are caused to rotate in the opposite rotation direction by the hydraulic motor 44 corresponds to the front side of the lower traveling body 6. In addition, the third and fourth combinations correspond to a case in which the wheel unit 30 is arranged to take a posture such that a movement direction of the wheels 36 when the wheels 36 are caused to rotate in the one rotation direction by the hydraulic motor 44 corresponds to the front side of the lower traveling body 6 and such that a movement direction of the wheels 36 when the wheels 36 are caused to rotate in the opposite rotation direction by the hydraulic motor 44 corresponds to the back side of the lower traveling body 6.

When determining that the combination of the read swing angle and steering angle corresponds to the first or second combination, the main-body-side controller 82 next determines to which of the forward-movement position and the backward-movement position the lever 9*a* has been operated in step S51 (step S54).

When determining that the lever 9*a* has been operated to the forward-movement position, the main-body-side controller 82 causes the carrier-side controller 84 to put the second switch valve 62 in the open state (step S56). When the second switch valve 62 is put in the open state, the control valve 50 is put in the second supply position 50*b* and the wheel driving device 38 is put in the second driving state in which the wheels 36 are caused to rotate in the opposite rotation direction by the hydraulic motor 44. Here, since a movement direction of the wheels 36 when the wheels 36 rotate in the opposite rotation direction is set to the front side of the lower traveling body 6, the wheels 36 travel to the front side of the lower traveling body 6. Accordingly, in this case, a traveling direction of the lower traveling body 6 caused to drive forward by the crawler devices 11 in response that the lever 9*a* is operated to the forward-movement position corresponds to the movement direction of the carrier 4.

When determining that the lever 9*a* has been operated to the backward-movement position, the main-body-side controller 82 causes the carrier-side controller 84 to put the first switch valve 61 in the open state (step S57). When the first switch valve 61 is put in the open state, the control valve 50 is put in the first supply position 50*a* and the wheel driving device 38 is put in the first driving state in which the wheels 36 are caused to rotate in the one rotation direction by the hydraulic motor 44. Here, since a movement direction of the wheels 36 when the wheels 36 rotate in the one rotation direction is set to the back side of the lower traveling body 6, the wheels 36 travel to the back side of the lower traveling body 6. Accordingly, in this case, a traveling direction of the lower traveling body 6 caused to drive backward by the crawler devices 11 in response that the lever 9*a* is operated to the backward-movement position corresponds to the movement direction of the carrier 4.

In addition, in step S53 when determining that the combination of the read swing angle and steering angle corresponds to the third or fourth combination, the main-body-side controller 82 next determines to which of the forward-movement position and the backward-movement position the lever 9*a* has been operated in step S51 (step S55).

When determining that the lever 9*a* has been operated to the forward-movement position, the main-body-side controller 82 causes the carrier-side controller 84 to put the first switch valve 61 in the open state (step S57). When the first switch valve 61 is put in the open state, the control valve 50 is put in the first supply position 50*a* and the wheel driving device 38 is put in the first driving state in which the wheels 36 are caused to rotate in the one rotation direction by the hydraulic motor 44. Here, since a movement direction of the wheels 36 when the wheels 36 rotate in the one rotation direction is set to the front side of the lower traveling body 6, the wheels 36 travel to the front side of the lower traveling body 6. Accordingly, in this case, a traveling direction of the lower traveling body 6 caused to drive forward by the crawler devices 11 in response that the lever 9*a* is operated to the forward-movement position corresponds to the movement direction of the carrier 4.

On the other hand, when determining that the lever 9*a* has been operated to the backward-movement position, the main-body-side controller 82 causes the carrier-side controller 84 to put the second switch valve 62 in the open state (step S56). When the second switch valve 62 is put in the open state, the control valve 50 is put in the second supply position 50*b* and the wheel driving device 38 is put in the second driving state in which the wheels 36 are caused to rotate in the opposite rotation direction by the hydraulic motor 44. Here, since a movement direction of the wheels 36 when the wheels 36 rotate in the opposite rotation direction is set to the back side of the lower traveling body 6, the wheels 36 travel to the back side of the lower traveling body 6. Accordingly, in this case, a traveling direction of the lower traveling body 6 caused to drive backward by the crawler devices 11 in response that the lever 9*a* is operated to the backward-movement position corresponds to the movement direction of the carrier 4.

In the way described above, the process of controlling a rotation direction of the wheels 36 is performed such that a movement direction of the carrier 4 based on the rotation of the wheels 36 of each of the wheel units 30 corresponds to a traveling direction of the lower traveling body 6 instructed by an operation of the lever 9*a*.

In the embodiment, the steering device 32 steers the wheel unit 30 by a steering operation that requires a smaller steering amount of the wheel unit 30 (the wheels 36) between one steering operation and another steering operation, one steering operation being a steering operation which causes the wheel unit 30 of the carrier 4 to swivel in one direction about the vertical axis C2 to make an orientation of each of the wheels 36 of the wheel unit 30 correspond to the front-back direction A of the lower traveling body 6, another steering operation being a steering operation which causes the wheel unit 30 to swivel in a direction opposite to the one direction about the vertical axis C2 to make an orientation of each of the wheels 36 of the wheel unit 30 correspond to the front-back direction A of the lower traveling body 6. Therefore, a steering amount of the wheel unit 30 (the wheels 36) may be reduced. Thus, a time required for an adjustment operation in which the wheel unit 30 of the carrier 4 is steered to make an orientation of the wheels 36 correspond to the front-back direction A of the lower traveling body 6 may be reduced.

In addition, in the embodiment, after the steering device 32 steers the wheel unit 30 such that an direction of the wheels 36 corresponds to the front-back direction A of the lower traveling body 6 by a steering operation that requires a smaller steering amount to steer the wheel unit 30, a rotation direction in which a movement direction of the wheels 36 corresponds to a traveling direction (the front or back side) of the lower traveling body 6 instructed by an operation of the lever 9*a* is selected from among both rotation directions about the horizontal axis of the wheels 36 according to the operation of the lever 9*a*, whereby the wheels 36 are caused to rotate in the selected rotation direction. Thus, a tensile load or a compression load axially applied to the coupling beam 5 when a movement direction of the carrier 4 (a movement direction of the wheels 36) based on the rotation of the wheels 36 becomes opposite to a traveling direction of the lower traveling body 6 may be prevented.

Moreover, the swing-angle detecting section 25 that detects a swing angle of the upper swing body 7 is one generally provided in a crane in which an upper swing body is able to slew, and the steering-angle detecting section 40 that detects a steering angle of the wheel unit 30 (the wheels 36) is one generally provided in a counterweight carrier in which a wheel unit is capable of being steered. In the embodiment, using the swing-angle detecting section 25 and the steering-angle detecting section 40 described above, a rotation direction of the wheels 36 in which a movement direction of the wheels 36 of the wheel unit 30 after steered by the steering device 32 is made correspondent to a traveling direction of the lower traveling body 6 is specified. Thus, a rotation direction of the wheels 36 in which a movement direction of the wheels 36 after steered by the steering device 32 is made correspondent to a traveling direction of the lower traveling body 6 may be specified while preventing the complexity of the configuration of the crane 2.

Note that the embodiment disclosed herein is just an exemplification in all respects and not limitative. The scope of the present invention is not indicated by the embodiment but is indicated by claims, and includes all modifications equivalent in meaning to and within the claims.

In order to detect a swing state of the upper swing body relative to the lower traveling body, any resort other than the swing-angle detecting section 25 may be used.

For example, position information on each of the front and rear ends of the upper swing body may be acquired by global positioning system (GPS) receivers provided in the front and rear ends of the upper swing body to detect a swing state of the upper swing body.

In addition, a swing state of the upper swing body may be detected using a detecting section having a limit switch that detects whether the upper swing body is put in a swing state in which the front side of the upper swing body corresponds to the front side of the lower traveling body and the back side of the upper swing body corresponds to the back side of the lower traveling body and having a limit switch that detects whether the upper swing body is put in a swing state in which the front side of the upper swing body corresponds to the back side of the lower traveling body and the back side of the upper swing body corresponds to the front side of the lower traveling body.

Moreover, a swing state of the upper swing body may be detected using a system that discriminates which direction the upper swing body faces relative to the lower traveling body based on image recognition.

Further, a system that measures a swing distance of the upper swing body using a rotary encoder and performs calculation based on its measurement result to derive a swing state of the upper swing body may be used.

Furthermore, in order to detect a steering angle of the wheels of the counterweight carrier, any resort other than the steering-angle detecting section 40 may be used. For example, any system similar to a detection system having GPS receivers, a detection system having limit switches, a detection system based on image recognition, a detection system using a rotary encoder as described above, or the like may be used to detect a steering angle of the wheels of the counterweight carrier.

Furthermore, in the embodiment, the main-body-side controller determines a rotation direction of the wheels of the carrier and transmits an instruction signal for causing the wheels to rotate in the rotation direction, and the carrier-side controller causes, after receiving the instruction signal, the wheel driving device to rotate the wheels in the rotation direction instructed by the instruction signal. However, the present invention is not necessarily limited to such a configuration. For example, the carrier-side controller may determine a rotation direction of the wheels of the carrier and cause the wheel driving device to rotate the wheels in the determined rotation direction. In this case, the information used by the main-body-side controller to determine the rotation direction of the wheels in the embodiment may be transmitted to the carrier-side controller, and the carrier-side controller may determine a rotation direction of the wheels of the carrier based on information received from the main-body-side controller and information received from the steering-angle detecting section.

Summary of Embodiment of Modified Example

The embodiment and the modified example are summarized as follows.

A mobile crane according to the embodiment and the modified example includes: a crane main-body having a lower traveling body capable of being self-propelled in a front-back direction and an upper swing body mounted on the lower traveling body to be capable of swinging; a coupling beam extending from the upper swing body to a back side of the upper swing body; and a counterweight carrier coupled to the upper swing body via the coupling beam and movable according to movement of the crane main-body in a state in which a counterweight is mounted on the counterweight carrier, wherein the counterweight carrier has a wheel rotatable in both directions about a horizontal axis, a wheel driving device which rotates the wheel, and a steering device which swivels the wheel about a vertical axis to steer the wheel, at least one of the crane main-body and the counterweight carrier has a posture instructing section configured to be operated to issue an instruction for causing the wheel to take a traveling posture with respect to the crane main-body during traveling the crane main-body, the traveling posture being a specific posture which the wheel takes by swiveling about the vertical axis, and a controller which causes the steering device to steer the wheel such that the wheel takes, as the traveling posture, a posture in which an orientation of the wheel corresponds to a front-back direction of the lower traveling body according to a swing state of the upper swing body when the posture instructing section is operated to issue the instruction for causing the wheel to take the traveling posture, and the controller causes the steering device to steer the wheel by a steering operation which requires a smaller steering amount of the wheel between one steering operation and another steering operation, one steering operation being a steering operation in which the steering device swivels the wheel in one direction about the vertical axis to make the orientation of the wheel correspond to the front-back direction of the lower traveling body, another steering operation being a steering operation in which the steering device swivels the wheel in a direction opposite to the one direction about the vertical axis to make the orientation of the wheel correspond to the front-back direction of the lower traveling body.

In the mobile crane, when the posture instructing section is operated to instruct the wheel of the counterweight carrier to take the traveling posture, the steering device steers the wheel by a steering operation that requires a smaller steering amount of the wheel between one steering operation and another steering operation, one steering operation being a steering operation which causes the wheel of the counterweight carrier to swivel in one direction about the vertical axis to make the orientation of the wheel correspond to the front-back direction of the lower traveling body, another steering operation being a steering operation which causes the wheel of the counterweight carrier to swivel in a direction opposite to the one direction about the vertical axis to make the orientation of the wheel correspond to the front-back direction of the lower traveling body. Thus, a steering amount of the wheel of the counterweight carrier may be reduced. Thus, a time required for an adjustment operation in which the wheel of the counterweight carrier is steered to make the orientation of the wheel correspond to the front-back direction of the lower traveling body may be reduced.

In the mobile crane, the crane main-body preferably has a traveling operation section configured to be operated to instruct forward traveling or backward traveling of the lower traveling body, the wheel driving device is preferably configured to switch between a first driving state and a second driving state, the first driving state being a driving state in which the wheel driving device rotates the wheel in one rotation direction, the second driving state being a driving state in which the wheel driving device rotates the wheel in a direction opposite to the one rotation direction, and the controller preferably performs, after the steering device steers the wheel such that the orientation of the wheel corresponds to the front-back direction of the lower traveling body, switch control of a driving state of the wheel driving device to put the wheel driving device in one driving state selected between the first driving state and the second driving state, one driving state being a state in which a movement direction of the wheel rotated by the wheel driving device corresponds to a traveling direction of the lower traveling body instructed by the operation of the traveling operation section.

According to the configuration, after the steering device steers the wheel such that an orientation of the wheel corresponds to the front-back direction of the lower traveling body by a steering operation that requires a smaller steering amount to steer the wheel, a rotation direction in which a movement direction of the wheel corresponds to a traveling direction of the lower traveling body instructed by an operation of the traveling operation section is selected from among both rotation directions about the horizontal axis of the wheel according to the operation of the traveling operation section, whereby the wheel is caused to rotate in the rotation direction. Thus, a load on the coupling beam applied when a movement direction of the counterweight carrier (a movement direction of the wheel) based on the rotation of the wheel becomes opposite to a traveling direction of the lower traveling body may be prevented.

In this case, the crane main-body preferably has a swing-angle detecting section that detects a swing angle of the upper swing body, the counterweight carrier preferably has a steering-angle detecting section that detects a steering angle of the wheel, and the controller preferably specifies, based on the swing angle detected by the swing-angle detecting section and the steering angle detected by the steering-angle detecting section in a state in which the steering device steers the wheel such that the orientation of the wheel corresponds to the front-back direction of the lower traveling body, a rotation direction of the wheel in which the movement direction of the wheel corresponds to the traveling direction of the lower traveling body instructed by the operation of the traveling operation section and puts the wheel driving device in a driving state in which the wheel is caused to rotate in the specified rotation direction, with the driving state being selected between the first driving state and the second driving state.

According to the configuration, a rotation direction of the wheel in which a movement direction of the wheel after steered by the steering device is made correspondent to a traveling direction of the lower traveling body may be specified while preventing the complexity of the configuration of the mobile crane. Specifically, in general, a crane main-body is provided with a swing-angle detecting section that detects a swing angle of an upper swing body, and a counterweight carrier configured to be capable of steering a wheel is provided with a steering-angle detecting section that detects a steering angle of a wheel. Thus, according to the configuration, using the swing-angle detecting section and the steering-angle detecting section described above, a rotation direction of the wheel in which a movement direction of the wheel after steered by the steering device is made correspondent to a traveling direction of the lower traveling body may be specified. Thus, a rotation direction of the wheel in which a movement direction of the wheel after steered by the steering device is made correspondent to a traveling direction of the lower traveling body may be specified while preventing the complexity of the configuration of the mobile crane.

As described above, the embodiment and the modified example may provide a mobile crane capable of reducing a time required for an adjustment operation in which the wheel of a counterweight carrier is steered to make an orientation of the wheel correspond to the front-back direction of the lower traveling body of a crane main-body.

This application is based on Japanese Patent application No. 2015-140303 filed in Japan Patent Office on Jul. 14, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A mobile crane comprising:

a crane main-body having a lower traveling body capable of self-traveling in a front-back direction and an upper swing body mounted on the lower traveling body to be capable of swinging;

a coupling beam extending from the upper swing body to a back side of the upper swing body; and a counterweight carrier coupled to the upper swing body via the coupling beam and movable according to movement of the crane main-body in a state in which a counterweight is mounted on the counterweight carrier, wherein the counterweight carrier has a wheel rotatable in both directions about a horizontal axis, a wheel driving device which rotates the wheel, and a steering device which swivels the wheel about a vertical axis to steer the wheel, at least one of the crane main-body and the counterweight carrier has a posture instructing section configured to be operated to issue an instruction for causing the wheel to take a traveling posture with respect to the crane main-body during traveling the crane main-body, the traveling posture being a specific posture which the wheel takes by swiveling about the vertical axis, and a controller which causes the steering device to steer the wheel such that the wheel takes, as the traveling posture, a posture in which an orientation of the wheel corresponds to a front-back direction of the lower traveling body according to a swing state of the upper swing body when the posture instructing section is operated to issue the instruction for causing the wheel to take the traveling posture, and the controller causes the steering device to steer the wheel by a steering operation which requires a smaller steering amount of the wheel between one steering operation and another steering operation, one steering operation being a steering operation in which the steering device swivels the wheel in one direction about the vertical axis to make the orientation of the wheel correspond to the front-back direction of the lower traveling body, another steering operation being a steering operation in which the steering device swivels the wheel in a direction opposite to the one direction about the vertical axis to make the orientation of the wheel correspond to the front-back direction of the lower traveling body.

2. The mobile crane according to claim 1, wherein the crane main-body has a traveling operation section configured to be operated to instruct forward traveling or backward traveling of the lower traveling body, the wheel driving device is configured to switch between a first driving state and a second driving state, the first driving state being a driving state in which the wheel driving device rotates the wheel in one rotation direction, the second driving state being a driving state in which the wheel driving device rotates the wheel in a direction opposite to the one rotation direction, and the controller performs, after the steering device steers the wheel such that the orientation of the wheel corresponds to the front-back direction of the lower traveling body, switch control of a driving state of the wheel driving device to put the wheel driving device in one driving state selected between the first driving state and the second driving state, one driving state being a state in which a movement direction of the wheel rotated by the wheel driving device corresponds to a traveling direction of the lower traveling body instructed by the operation of the traveling operation section.

3. The mobile crane according to claim 2, wherein the crane main-body has a swing-angle detecting section which detects a swing angle of the upper swing body, the counterweight carrier has a steering-angle detecting section which detects a steering angle of the wheel, the controller specifies, based on the swing angle detected by the swing-angle detecting section and the steering angle detected by the steering-angle detecting section in a state in which the wheel is steered by the steering device such that the orientation of the wheel corresponds to the front-back direction of the lower traveling body, a rotation direction of the wheel in which the movement direction of the wheel corresponds to the traveling direction of the lower traveling body instructed by the operation of the traveling operation section, and the controller puts the wheel driving device in a driving state in which the wheel driving device rotates the wheel in the specified rotation direction, the driving state being either the first driving state or the second driving state.

* * * * *